US007328893B2

(12) United States Patent
Kawatsu et al.

(10) Patent No.: US 7,328,893 B2
(45) Date of Patent: Feb. 12, 2008

(54) FINISHER AND IMAGE FORMING APPARATUS EQUIPPED THEREWITH

(75) Inventors: Kenji Kawatsu, Machida (JP); Toshio Shida, Higashiyamato (JP); Hiroyuki Wakabayashi, Hachioji (JP); Masaaki Uchiyama, Hachioji (JP); Masato Hattori, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 196 days.

(21) Appl. No.: 10/991,275

(22) Filed: Nov. 17, 2004

(65) Prior Publication Data

US 2005/0230895 A1 Oct. 20, 2005

(30) Foreign Application Priority Data

Apr. 20, 2004 (JP) ..... 2004-123874

(51) Int. Cl.
*B65H 37/04* (2006.01)

(52) U.S. Cl. ..... 270/58.09; 270/52.17; 270/58.07; 412/16; 493/356; 493/357; 83/856; 83/934

(58) Field of Classification Search ..... 270/52.17, 270/58.07, 58.09; 412/16; 493/356, 357; 83/856, 934

See application file for complete search history.

(56) References Cited

U.S. PATENT DOCUMENTS 3,633,727 A * 1/1972 Brenner ..... 198/412
5,501,442 A * 3/1996 Mandel ..... 270/58.07
2002/0044852 A1* 4/2002 Nogawa et al. ..... 412/16
2003/0214092 A1* 11/2003 Horii et al. ..... 270/52.18
2004/0096253 A1* 5/2004 Ueno et al. ..... 399/385
2005/0062208 A1* 3/2005 Wakabayashi et al. ..... 270/32

FOREIGN PATENT DOCUMENTS

JP 5-162479 6/1993
JP 2000-198613 7/2000

OTHER PUBLICATIONS

English Abstract for JP 2000-198613 dated Jul. 18, 2000.
Office Action for Patent Application No. 2004-309318 mailed Oct. 2, 2007.

* cited by examiner

*Primary Examiner*—Gene O. Crawford
*Assistant Examiner*—Leslie A Nicholson, III
(74) *Attorney, Agent, or Firm*—Cantor Colburn LLP

(57) ABSTRACT

A finisher for finishing a booklet having a bundle of center-folded sheets, includes: a detector for detecting an end on a side of a folded portion of the booklet: a moving device for conveying the booklet by movement thereof; a controller for controlling the movement of the moving device; and a cutting device for cutting an edge on a side opposite to the end of the booklet, which has been conveyed by the moving device to a cutting position. The controller controls the movement of the moving device from a position where the detector has detected the end of the folded portion to the cutting position so that a size of a booklet after being cut is kept constant for each of sheet sizes.

13 Claims, 26 Drawing Sheets

FIG. 12 ( a )
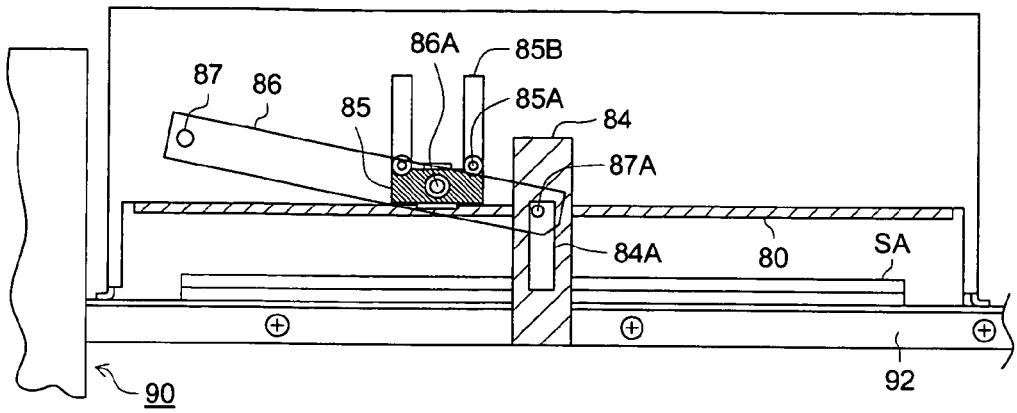
FIG. 12 ( b )
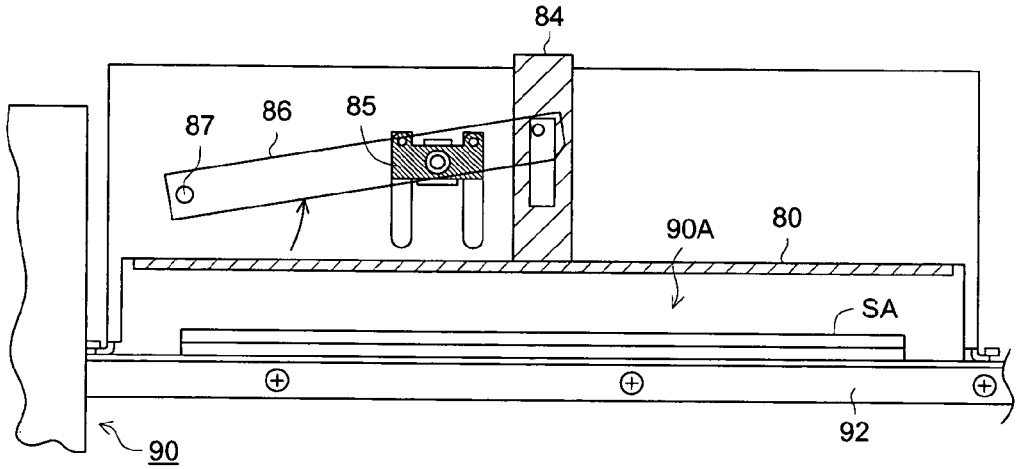
FIG. 12 ( c )
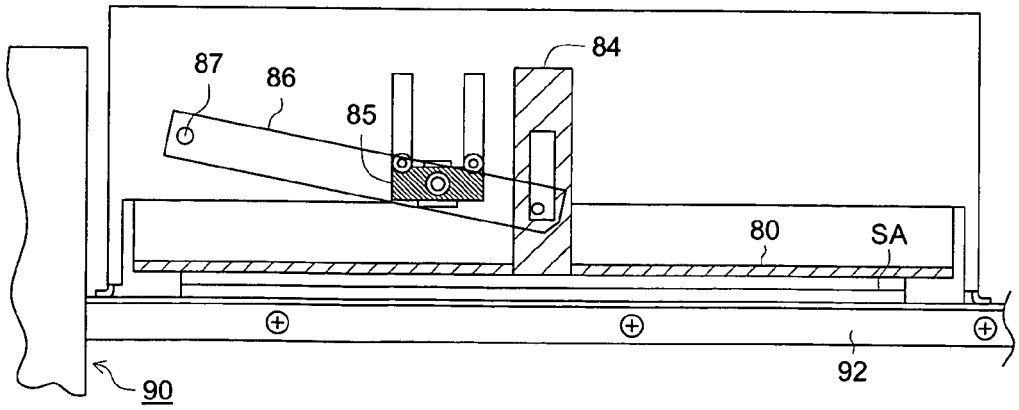

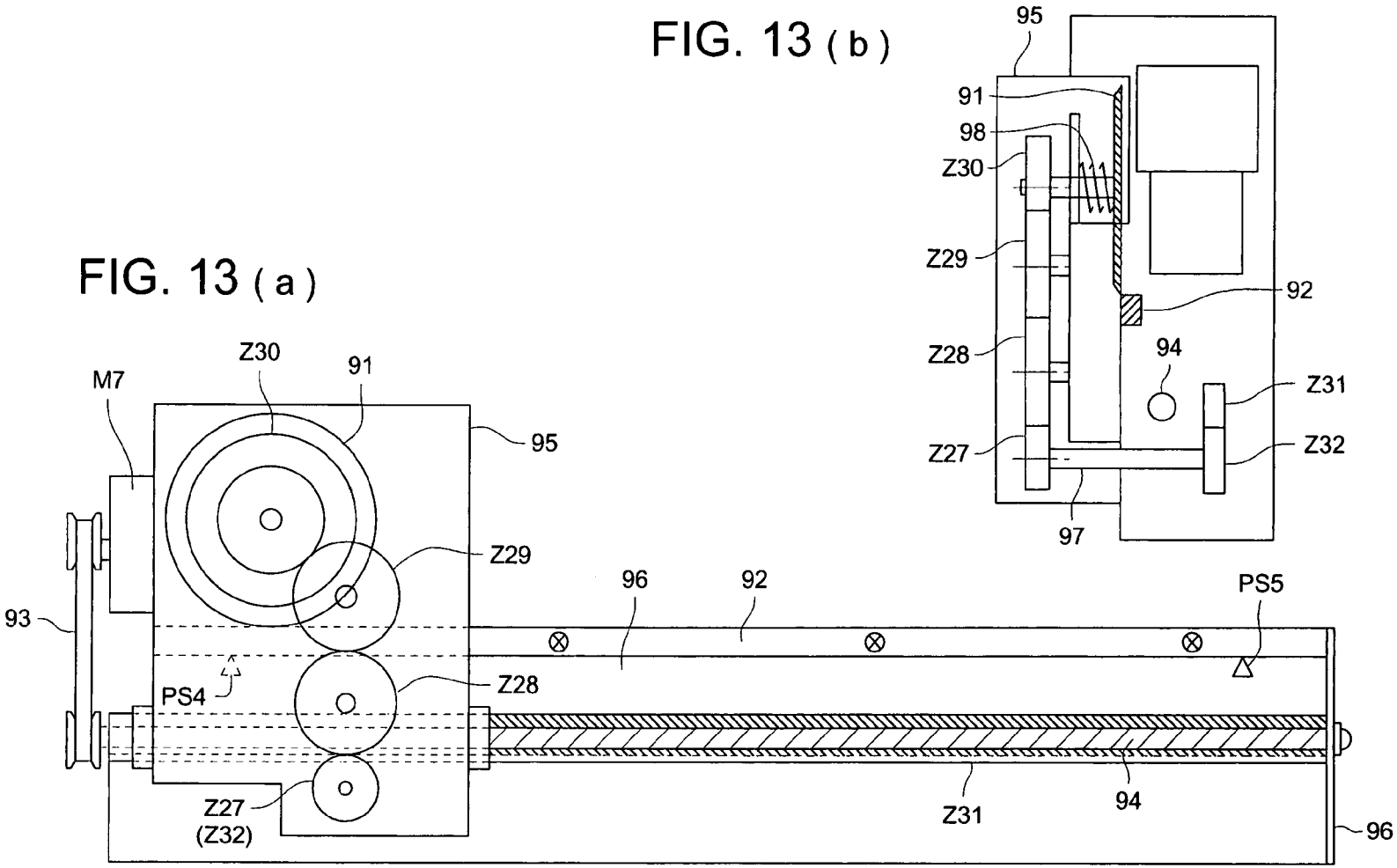
FIG. 13 ( b )
FIG. 13 ( a )

FIG. 23 ( a )
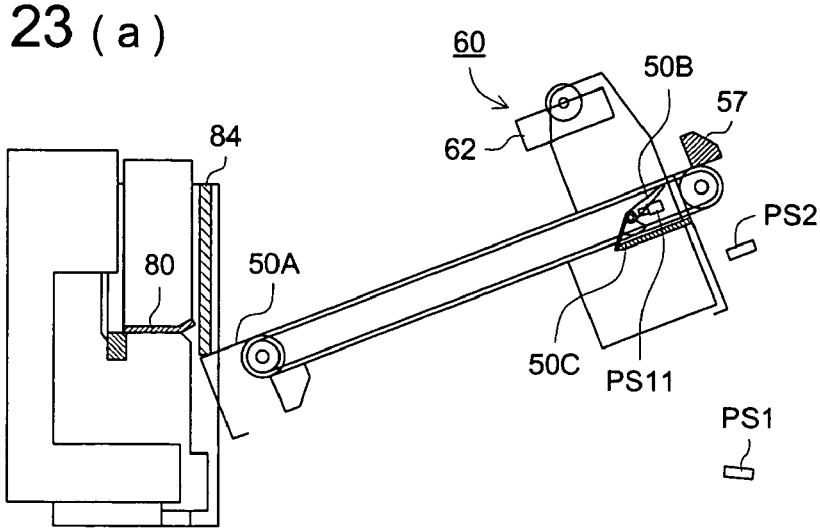
FIG. 23 ( b )
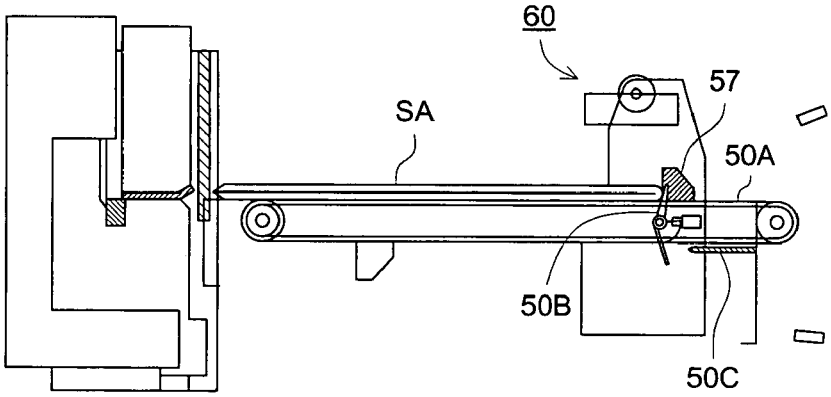
FIG. 23 ( c )
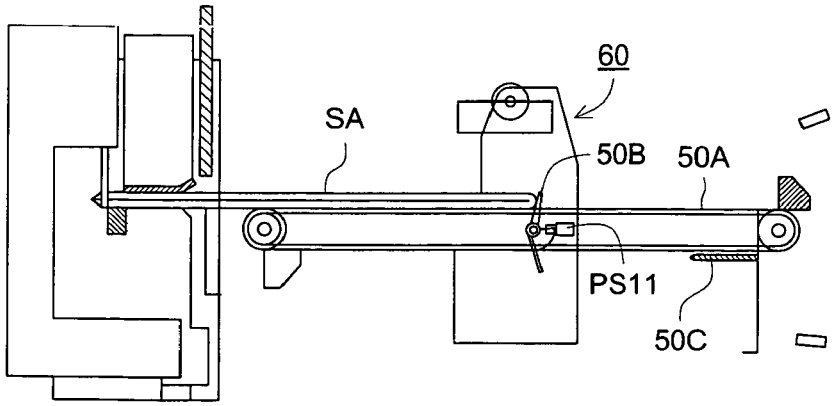

FINISHER AND IMAGE FORMING APPARATUS EQUIPPED THEREWITH

The present invention relates to a finisher that-cuts the edges of a booklet prepared by center-folding the sheets and binds the booklet, and to image forming apparatus containing such a sheet finisher.

BACKGROUND OF THE INVENTION

Conventionally, a finisher that comprises a cutting device that cuts and aligns the edges of booklet prepared by center-stapling and center folding have been realized in the printing industry.

Further, in recent years, sheet finishers have been proposed that accept sheets on which images have been formed by an image forming apparatus such as copiers, printers, etc., carries out center-stapling and center-folding processes on them to bind into a booklet like a weekly magazine, and which comprise a cutting device that thereafter cuts and aligns the edges of the booklet.

The cutting device disclosed in Patent Document 1 (representing Japanese Patent Application Laid Open No. 2000-198613) is one in which the booklet after center-stapling and center-folding has been transported with its folded part at the front, is passed through the first transporting means, the cutting means, and the second transporting means and stops when the folded part comes into contact with a movable stopper, is pressed by the first pressing means at the folded part and by a second pressing means at the edge part, and its edge is cut by the cutting means.

In the conventional apparatus, as has been disclosed in Patent Document 1, the booklet after center-stapling and center-folding is transported by a rotating transporting belt and is inserted into the cutting section of the cutting means with its folded part at the front, after the front end of the booklet comes into contact with the leading edge stopper that has projected into the booklet transportation path and the booklet stops, in the condition of being pressed by the pressing means that can come down or move up, the edge of the booklet on the rear side of the booklet in the direction of its transportation is cut by the cutting means. The booklet whose edge has been cut is transported with its folded side facing the front and is stacked in the booklet storage section.

In other words, in the conventional cutting device, in order to receive a center-folded and thickly bloated booklet, a pressing member is placed at a high position above the booklet, after the leading end of the booklet comes into contact with the stopper and the booklet stops, the transporting belt is made to overrun, and when the folded part of the booklet has got in full contact with the stopper, the booklet is first pressed down by lowering the pressing member, and then the edge cutting operation is made.

Further, in this cutting method, since the amount of movement to be made by moving the leading edge stopper by driving the first driving means to the specific location depending on the sheet size and number of sheets of paper and the amount of movement of the booklet to make the front end part of the booklet push against the leading edge stopper by driving the second transporting means using the second drive means, and the amount of movement of the pressing means that presses the top surface of the booklet are all set individually and since they are all carried out by different driving means, there is the problem that the apparatus becomes complex and also the-control of the timings of these plural driving means becomes difficult.

SUMMARY OF THE INVENTION

The purpose of the present invention is to provide a sheet finisher with a simple configuration and to provide an image forming apparatus in which improvement in the booklet quality is achieved in a cutting device that cuts the edge of booklets that are transported after center-folding, by stabilizing the booklet transportation and by making highly accurate the dimensions of cutting the booklet whose edges are cut.

The above purposes are achieved in the present invention by a sheet finisher and an image forming apparatus having any one of the structures (1) to (3) described below.

(1) A finisher that carries out finishing of booklet that is stack of center-folded sheets and that includes the following: a moving means (moving device) that is provided with a detector for detecting an end of a center-folded portion of the booklet and that transports the booklet by moving them; a control means (controller) that controls the movement of the moving means; a cutting means (cutting device) that cuts an edge opposite to the end of the booklet transported up to a cutting position by the moving means; and the control means controls the movement of the moving means from the position at which the detector detected the end of the booklet to the cutting position so that the size of the booklet after cutting is made constant for all sheet sizes.

(2) A finisher that carries out finishing of a booklet that is a stack of center-folded sheets and that includes the following: a moving means (moving device) that is provided with a detector for detecting an end of a center-folded portion of the booklet and that transports the booklet by moving them; a control means (controller) that controls the movement of the moving means; a cutting means (cutting device) that cuts an edge opposite to the end of the center-folded portion of the booklet transported up to a cutting position by the moving means; and the control means carries out control such that it moves the moving means towards the cutting position, after stopping once the moving means based on the result of detection of the detector, returns the moving means while gripping the booklet to a specific reference position, and then moves the moving means by a movement distance stipulated for the sheet size of the booklet from the reference position to the cutting position.

(3) An image forming apparatus provided with a finisher that carries out finishing of a booklet that is a stack of center-folded sheets, and with the image forming apparatus additionally including the following: an image recording section that records an image on the sheet constituting the booklet; a moving means (moving device) that is provided with a detector for detecting an end of a center-folded portion of the booklet and that transports the booklet by moving them; a control means (controller) that controls the movement of the moving means; a cutting means (cutting device) that cuts the edge of the booklet transported up to the cutting position by the moving means; and the control means controls the movement of the moving means from the position at which the detector detected the end of the booklet to the cutting position so that the size of the booklet after cutting is made constant for all sheet sizes.

Furthermore, the above purposes of the invention are achieved by a sheet finisher and an image forming apparatus having any one of the still more preferable Structures (4) to (10) described below.

(4) A sheet finisher with the feature that it includes a booklet transporting means that transports booklet prepared by center-stapling and center-folding stack of sheets and placed on top of a booklet carrying table, a detecting means that detects the position of the folding part of the booklet transported by the booklet transporting means, a booklet gripping and conveying means that is composed of a pressing member that grips the booklet by pressing down upon it and a moving body that transports the pressing member, a cutting device that cuts the edge of the booklet, a driving means that conveys the booklet gripping and conveying means from the home position to the cutting section of the cutting device, and a control means that controls the booklet gripping and conveying means and the driving means, wherein the control means controls the driving means so that the booklet gripping and conveying means is moved from the home position up to and is stopped at the position of booklet folding part detection at which the booklet folding part detection means detects the folding part of the booklet being transported by the booklet transporting means, and moves the booklet gripping and conveying means to the cutting position in the state in which the top surface of the booklet is pressed by the pressing member thereby gripping the booklet, so that the amount of cutting by the cutting device becomes the specific cutting amount.

(5) The sheet finisher according to Structure (4) above with the feature that the specific distance of movement of the booklet gripping and conveying means from the home position to the cutting position is controlled depending upon the sheet size and number of sheets of paper in the booklet.

(6) The sheet finisher according to Structure (4) above with the feature that the detection means that detects the position of the folding part of the booklet goes into the not-detected state when the booklet gripping and conveying means is positioned near the home position, and the detection means goes into the detected state when the booklet gripping and conveying means gets separated from the home position by a specific distance.

(7) The sheet finisher according to Structure (4) or Structure (6) above with the feature that the detection means is positioned at a specific position of the moving body and is composed of an actuator that is capable of swinging movement and that is projecting from the top booklet placing surface of the booklet carrying table and comes into contact against the folded end of the booklet, and a sensor that detects the contact between the actuator and the folded part of the booklet.

(8) A sheet finisher with the feature that it includes a booklet transporting means that transports a booklet prepared by center-stapling and center-folding stack of sheets and placed on top of a booklet carrying table, a detecting means that detects the position of the folding part of the booklet transported by the booklet transporting means, a booklet gripping and conveying means that is composed of a pressing member that grips the booklet by pressing down upon it and a moving body that transports the pressing member, a cutting device that cuts the edge of the booklet, a driving means that conveys the booklet gripping and conveying means from the home position to the cutting section of the cutting device, and a control means that controls the booklet gripping and conveying means and the driving means, wherein the control means controls the driving means so that the booklet gripping and conveying means is moved from the home position up to and is stopped at the position of booklet folding part detection at which the booklet folding part detection means detects the folding part of the booklet being transported by the booklet transporting means, and moves the booklet gripping and conveying means to the home position in the state in which the top surface of the booklet is pressed by the pressing member thereby gripping the booklet, and then moves again the booklet gripping and conveying means to the cutting position so that the amount of cutting by the cutting device of the booklet, in the state in which the top surface of the booklet is pressed by the pressing member thereby gripping the booklet, becomes the specific cutting amount.

(9) The sheet finisher according to Structure (4) or Structure (8) above with the feature that the booklet pressed and gripped by the pressing member after the aligning member is separated from the folding part of the booklet.

(10) The sheet finisher according to Structure (4) or Structure (8) above with the feature that the drive source of the driving means is a stepping motor.

As has been described above, it is possible to obtain the following effects from the sheet finisher and image forming apparatus according to the present invention.

Using the finisher and image forming apparatus according to the present invention it is possible to cut the appropriate amount suitable for different sheet sizes for each booklet and to prepare high quality booklets with relatively simple controls.

BRIEF DESCRIPTION OF THE DRAWINGS

FIGS. 12(*a*)-12(*c*) are side views of the neighborhood of the cutting device;

FIGS. 13(*a*) and 13(*b*) are a front view and a side cross-sectional view of the cutting device;

FIGS. 23(*a*)-23(*c*) are cross-sectional views showing the booklet transporting means based on other preferred embodiments of the booklet folded part detection means;

DETAILED DESCRIPTION OF THE PREFERRED EMBODIMENT

Figure 1:
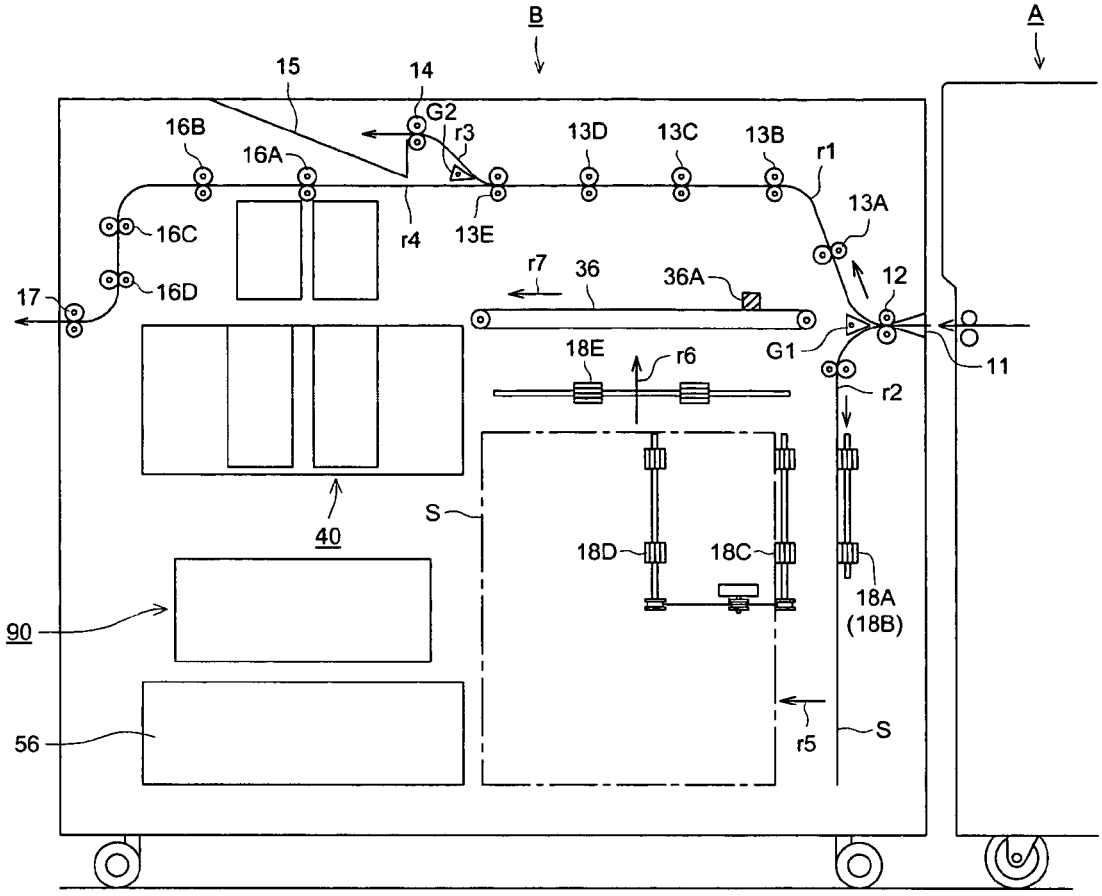
FIG. 1 is a schematic diagram showing the sheet transport during the center-folding and center-stapling processes of a sheet finisher.

The sheet finisher according to the present invention is described in detail in the following while referring to the drawings. Furthermore, it is to be understood that the sheet finisher according to the present invention shall not be limited to the following preferred embodiment alone.

(Sheet Finisher)

Figure 2:
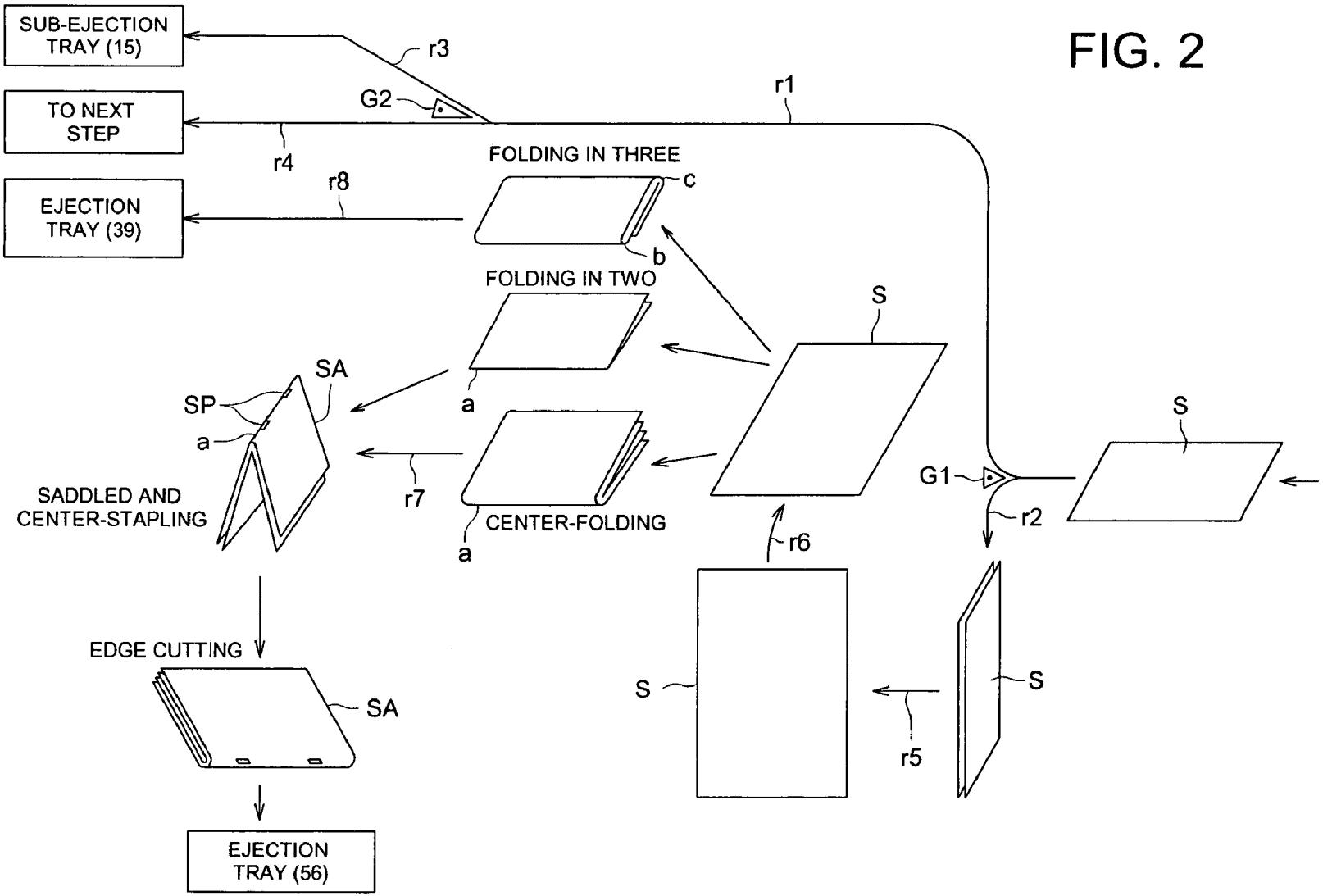
FIG. 2 is a schematic diagram showing the sheet transport process of a sheet finisher.
Figure 3:
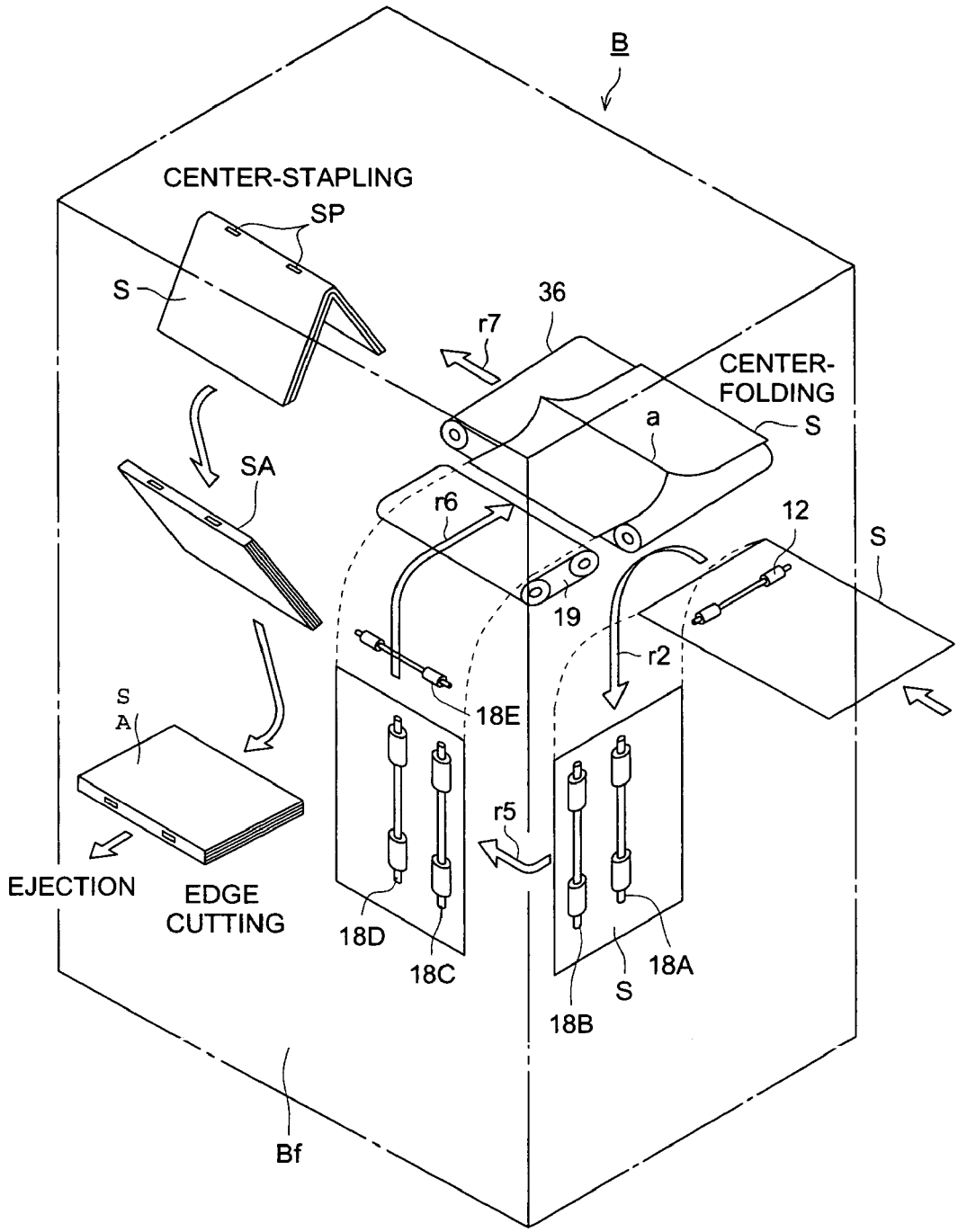
FIG. 3 is a front view of the sheet finisher.
Figure 4:
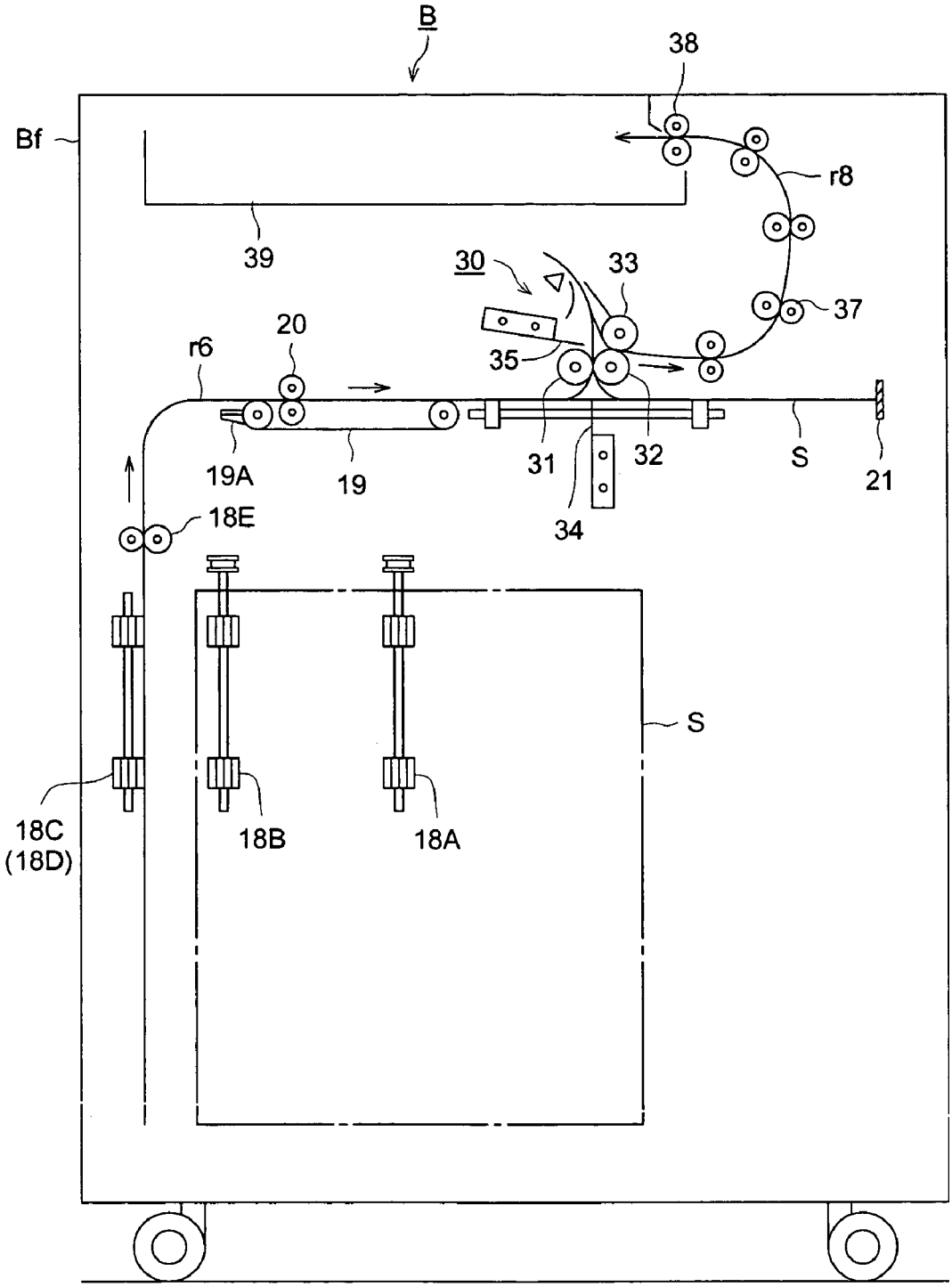
FIG. 4 is a right side view of the sheet finisher.
Figure 5:
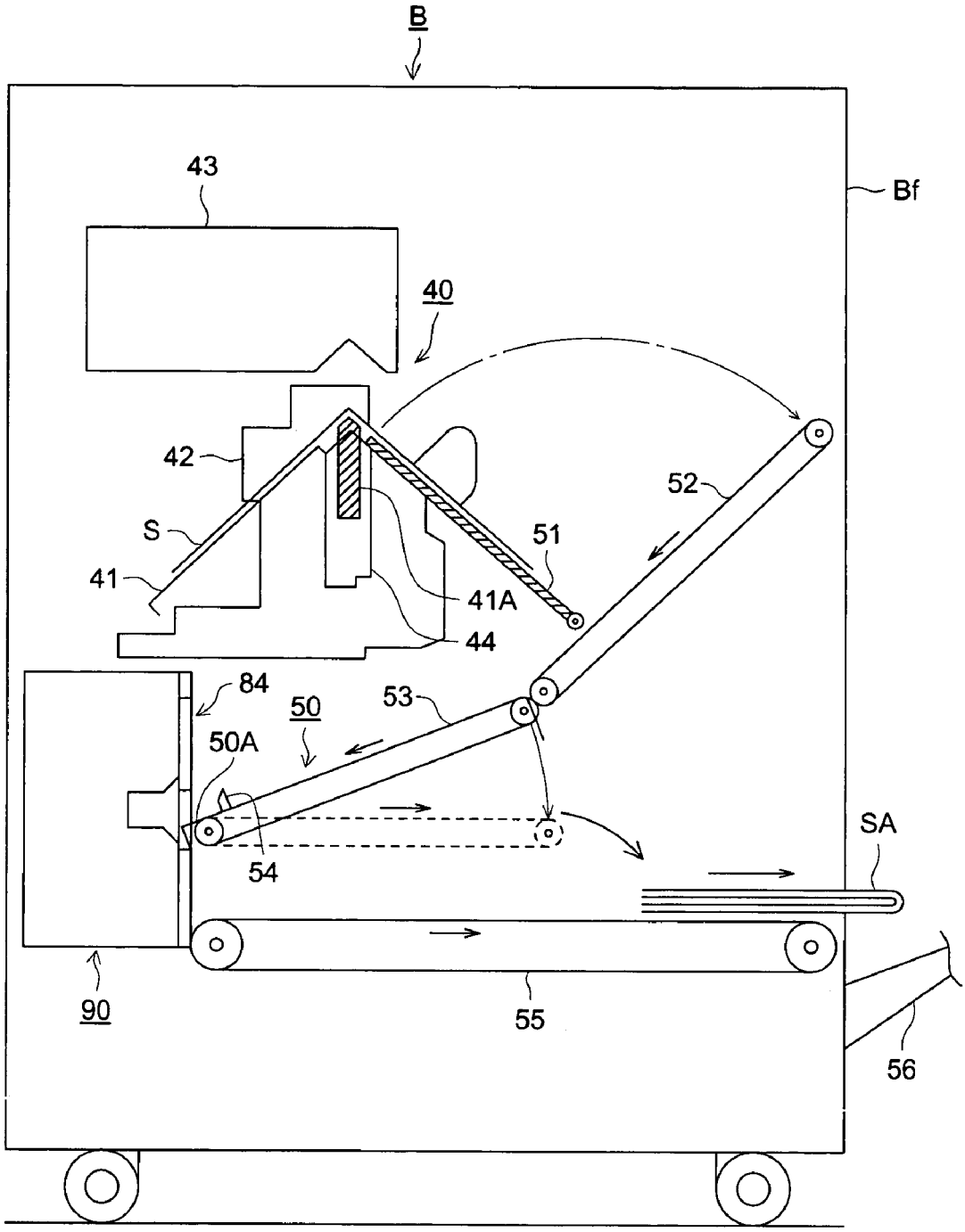
FIG. 5 is a left side view of the sheet finisher.

FIG. 1 is a schematic diagram showing the sheet transport during the center-folding and center-stapling processes of the sheet finisher B, FIG. 2 is a schematic diagram showing the sheet transport process of the sheet finisher B, FIG. 3 is the front view of the finisher B, FIG. 4 is the right side view and FIG. 5 is the left side view.

As is shown in FIG. 1, the sheet finisher B has been installed in the image processing apparatus A, the sheet on which image has been recorded in the image recording section of the image forming apparatus A is transported to the sheet finisher B which carries out finishing of the sheet.

Firstly, the sheet transporting process from acceptance of the sheet up to before carrying out the folding operation is described below.

As is shown in FIG. 2 and FIG. 3, when the sheet S discharged from the image forming apparatus A is guided to the inlet section 11 of the sheet finisher B, it is gripped by the inlet roller 12 and is transported either to the upper transport path r1 of the lower transported path r2 of the transport path selection means G1.

<Direct Sheet Discharge>

The sheet S that is branched to the transport path r1 is gripped and transported by the transport rollers 13A-13E, and is transported either to the upper transport path r3 or to the lower transport path r4 of the transport path selection means G2.

The sheet S that has proceeded to the upper transport path r3, is discharged by the sheet discharge roller 14 and is stacked on the auxiliary sheet discharge tray 15 located in the top part of the sheet finisher B.

The sheet S that has proceeded to the lower transport path r4 is gripped and transported by the transport rollers 16A-16D, and is then discharged by the sheet discharge roller 17.

<First Right Angle Direction Changing Transportation>

The sheet S that has been transported to the lower transport path r2 of the transport path selection means G1 descends almost vertically and is stored after temporarily halting for a specific period of time. In this halting position, several sheets of sheet S that arrive thereafter are stored one on top of another.

<Second Right Angle Direction Changing Transportation>

The sheet S that has been stored is moved by the transport rollers 18A-18E and the guide plate not shown in the figure changing the direction towards the front of and perpendicular to the sheet surface of FIG. 2, passes, in the state in which the sheet surface is kept vertical, the transport path r5 that goes round the front side Bf inside the sheet finisher B, and temporarily halts at a specific position.

<Third Right Angle Direction Changing Transportation>

Next, after the sheet S is transported in the vertical direction by the transport roller 18E its direction is changed to the horizontal direction and is transported towards the aligning means by the transport aligning belt 19 and the transport roller 20 (transport path r6).

<Alignment Before Folding>

Aligning means is placed on the downward side in the sheet transport path r6, and includes an aligning member 21 that positions the sheet by contacting their front edge of the sheet and movable aligning member 19A that moves the sheet by pressing at its rear end. The aligning member 19A presses the rear end of the sheet S that is transported by the transport roller 20 placed at the upward side in the sheet transport direction of the transport path r6 and transports the sheet S up to the aligning member 21 and carries out sheet alignment by making the front edge of the sheet coming into contact with the aligning member 21.

The center-folding process, center-stapling process, booklet edge cutting process of the sheet S in the sheet finisher B are explained below in concrete terms.

<Center-folding Mechanism>

The center-folding section 30 is placed on the downward side of the transport aligning belt 19. The folding section 30 includes the folding rollers 31, 32, 33, the first folding plate 34 and the second folding plate 35.

<Folding-in-Two Process>

One r2 plural sheet of the sheet S arriving at folding section 30 are gripped by the folding rollers 31, 32 rotating mutually in opposite directions and by first folding plate 34 moving forward and folded in two thereby forming the folding line 'a' (see FIG. 2) along the width direction of the sheet at the center of the sheet transport direction (see FIG. 4). The sheet S folded in two passes the transport path of the center folding process to be described later and is discharged to the sheet discharge tray 56.

<Folding-in-Three Process>

When carrying out folding-in-three in the folding section 30, after folding-in-three operation is done by forming the first folding line 'b' in the-sheet S by the folding rollers 31 and 32 and the first folding plate member and forming the second folding line C of the sheet S by the folding rollers 31 and 32 and the second folding plate member 35, it is passed through the transport path r8 which is composed of plurality of transport rollers 37 and guide plate and is discharged to the sheet discharge tray 39 by the sheet discharge roller 38.

<Center-folding Process>

The sheet S is subjected to folding-in-two process by forming the folding line 'a' is separated from the nipping position of the folding rollers 31 and 32 by the reverse rotation of the folding rollers 31 and 32 and return to the original horizontal transport path. Subsequently, the sheet S is transported to the transport path r7 in the direction of an extended line of folding line 'a' (see FIG. 2 and FIG. 1) by the transport tab 36A (see FIG. 3) fixed to the rotating transport belt 36 and is transported to the center stapling section 40.

In this manner, it is possible to prepare high quality booklets SA (bound books) with a small amount of bulging of the folding line 'a' by making the folding section 30 carry out center-folding of a small number of sheets, such as 1 to 3 sheets of sheet S firmly forming the folding line 'a' and successively sending to the center-stapling section 40.

<Center-Stapling Process>

The sheet S center-folded in the folding section 30 is transported in the direction of the transport path r7 by the transport belt 36 and the guiding means, not shown in the figure, and is placed on the saddling collection member 41 of the center-stapling section 40. The subsequent center-folded sheets of sheet S are successively passed through the transport path r7 and are accumulated on the saddling collection member 41.

The saddling collection member 41 is made up of two almost intersecting guide plates and is fixed to the body of the apparatus. Near the apex part of the saddling collection member 41 is placed a pressing member 41A which is provided with springs and which can be raised or lowered and is supported by the staple receptacle mechanism 44 (see FIG. 5).

The apex part of the pressing member 41A has an almost right-angled projection shape, the folding line 'a' of the center-folded sheet S is placed on the ridge of that apex part (see FIG. 2).

The plural sheets of sheet S placed on top of the saddling collection 41 and pressing member 41A have their position aligned by the width aligning means 42.

The stapling mechanism 43 is placed in a fixed position above the pressing member 41A. Inside the saddling collection member 41 are supported the pressing member 41A and the stapled receptacle mechanism 44 so that they can move in the up-and-down direction.

Two sets of the stapling means with a split structure comprising the stapling mechanism 43 and the stapled receptacle mechanism 44 are placed along the sheet folding line direction. When the center stapling process is selected in the console section the stapled receptacle mechanism 44 rises thereby carrying out center stapling. In other words, the two sets of stapling means affix the staples SP at two locations about the center along the folding line 'a' of the booklet SA on the pressing member 41A (see FIG. 1). A center-folded and center-stapled booklet SA is shown in FIG. 1.

<Booklet Cutting Process>

The booklet SA center-stapling section 40 is supported by the guiding member 51 of the booklet transporting means 50 and is swung in the direction indicated by the dot and dash line and placed on the transport belt 52. The booklet SA is transported in an inclined downward position due to the rotation of the transport belt 52, and in addition, and is held in the inclined state and transported by the rotating transport belt 53 and stops at specific position.

Thereafter, the transport belt 53 swings and goes into the horizontal stage. The edge (the free end on the opposite end of the folding line) of the booklet SA placed on this transport belt 53 which has gone into the horizontal stage will have fluctuations depending on the number of sheets of the sheet in the booklets SA and the edges are aligned using the cutting device.

The cut finished booklet SA is placed on the transport belt 53 rotating in the reverse direction and transported in the state in which the rear end of the booklet SA is pressed by the movable-aligning member 54 fixed to the transport belt 53, and is dropped in the direction of the arrow from the front end of the transport belt 53. The dropped booklet SA is discharged by the rotating discharge belt 55 to the discharge tray 56 placed outside the front side Bf of the sheet finisher B.

(Edge-Cutting Process)

Next, the details of the mechanisms of the cutting device 90 and of the booklet transport and drive means are described below.

<Booklet Transport and Drive Means>

Figure 6:
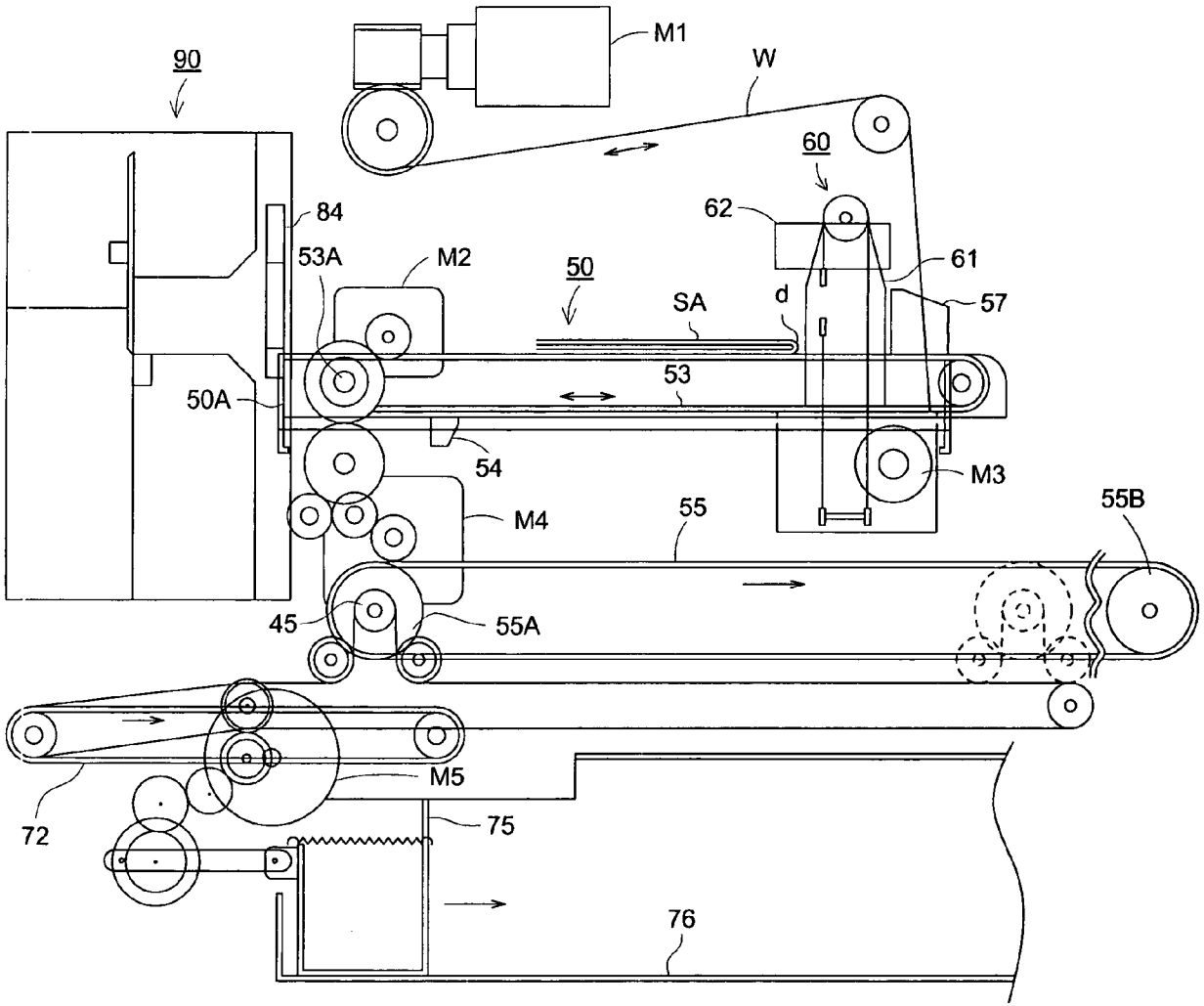
FIG. 6 is an overall view of the booklet transport and drive mechanism.

FIG. 6 is an overall diagram of the booklet transport and drive mechanism.

The motor M1 swings the transport belt 53 via the wire W centering on the drive roller rotating shaft 53A. The motor M2 rotates in the forward direction the transport belt 53, which has an integral structure with the movable aligning member 54. The motor M3 raises or lowers the pressure member 62 that presses the neighborhood of the folding part 'd' of the booklet SA. The motor M4 transports linearly in the booklet transport direction the moving body 61 of the booklet gripping and conveying means 60 (moving means) (details will be described in FIG. 8). The motor MS carries out the rotation of the discharge belt 55 that goes round the drive roller 55A and the driven roller 55B, the rotation of the cutting waste transport belt 72, and the movement of the transfer member 75 of the cutting waste collection box 76.

Figure 7:
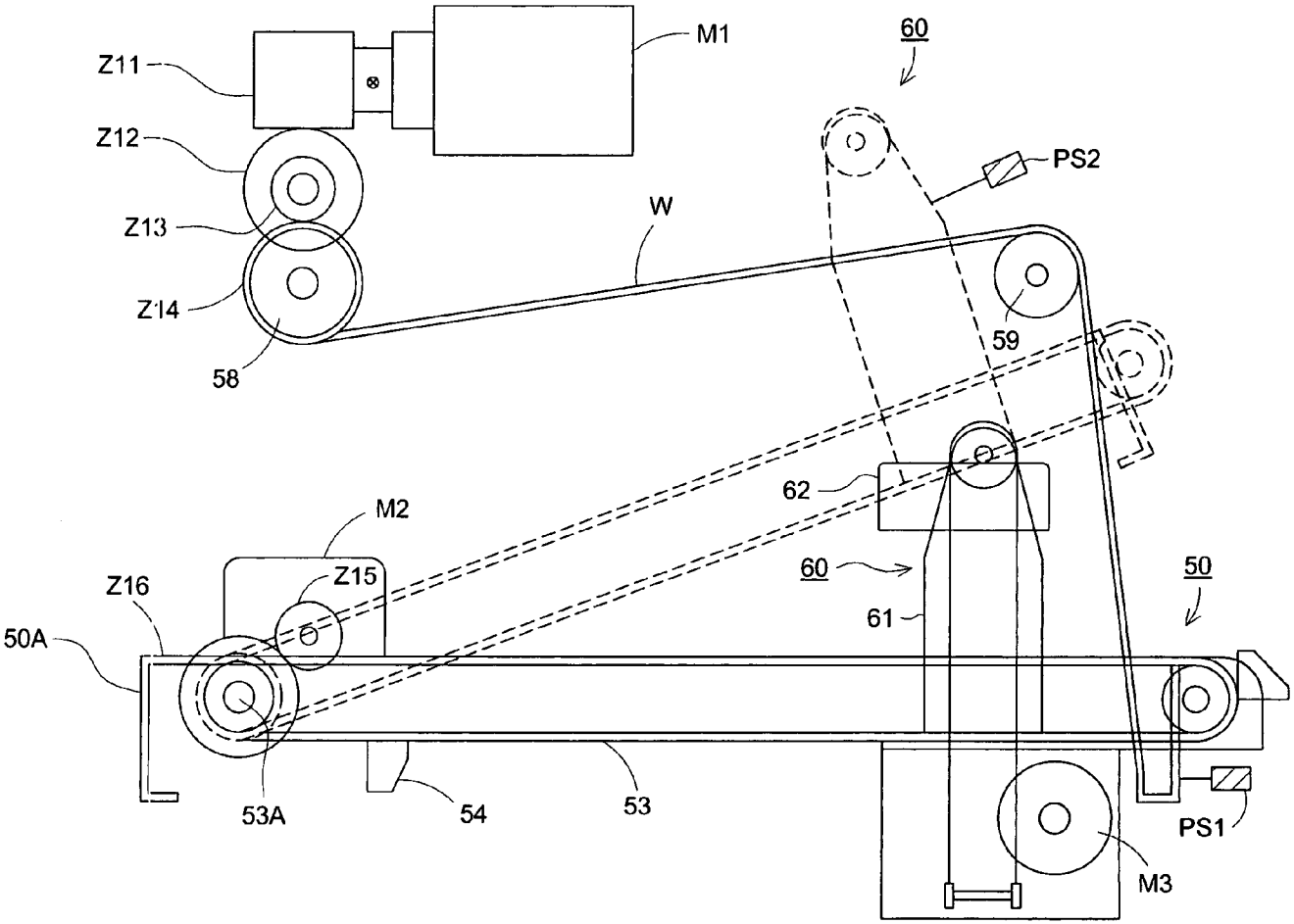
FIG. 7 is a cross-sectional view of the swinging mechanism that carries out swinging movement of the booklet transporting means and of the transporting belt.

FIG. 7 is a cross-sectional diagram of the swinging movement of the booklet transporting means 50.

The transport belt 53 of the booklet transporting means 50 is supported in a free to swing manner centering on the drive roller rotation shaft 53A. The wire W whose one end is connected to the end part (right side of the figure) of the booklet transporting means 50, is passed on the peripheral surface of the intermediate roller 59, which is supported in a rotatable manner by the body of the apparatus, has its direction changed, is passed around the outer periphery of the pulley 58 and the end of the wire is connected to a part of the pulley 58.

The gear Z14 fixed on the rotating shaft of the pulley 58 is coupled wire intermediate gears Z13 and Z12 to gear Z11 fixed to the drive shaft of the motor M1.

The pulley 58 rotates due to the drive from motor M1, winds up the wire W, pulls up the booklet transporting means 50 composed of the booklet placement table 50A, the transport belt 53, etc. raises it by swinging upward centering on the drive roller rotation shaft 53A. The raised position of the booklet transporting means 50 is shown by broken lines PS1 is a sensor detecting the lower limit position of the booklet transporting means 50 and PS2 is a sensor detecting the upper limit position of the booklet transporting means 50.

When lowering the booklet transporting means 50 to the horizontal position, the motor M1 is driven in the reverse direction, the pulley 58 is rotated in the reversed direction and the tension force of the wire W is released where upon the booklet transporting means 50 goes down because of its own weight.

The motor M2 rotates the drive roller rotation shaft 53A via the gears Z15 and Z16 and rotates the transport belt 53 in the forward and reverse directions.

<Ascent-and-descent Drive Means of Pressure Plate>

Figure 8:
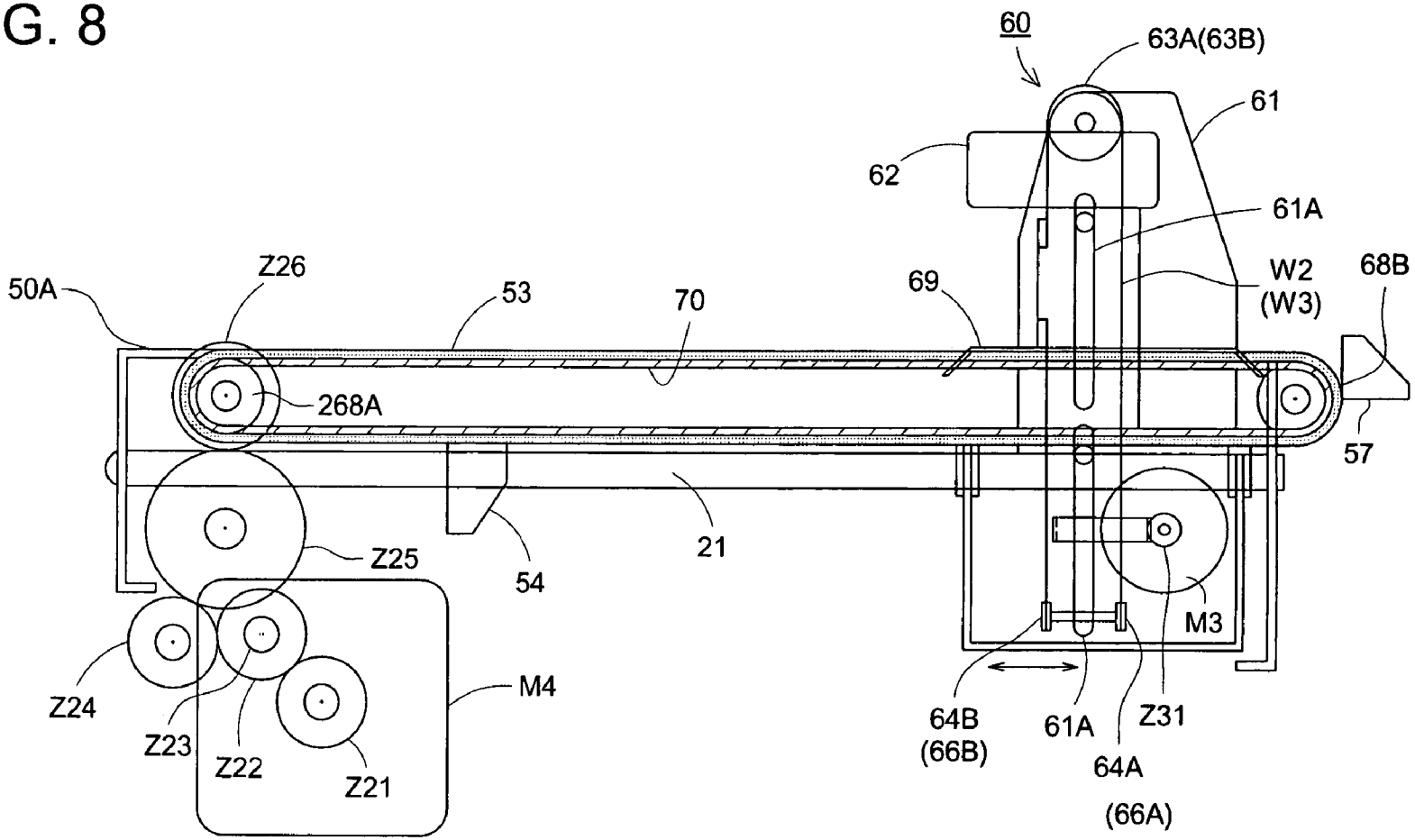
FIG. 8 is a cross-sectional view showing the ascending and descending drive means of the pressing plate and the booklet gripping and conveying member.

FIG. 8 is a cross-sectional diagram of the gripping and conveying means 60 (moving means) and the booklet aligning means.

The booklet gripping and conveying means 60 includes the moving body 61, the booklet supporting plate 69 fixed to the moving body 61, the pressing member 62 capable of up-and-down movement, moving body drive means, and pressure plate up-and-down drive means.

The motor M3 raises or lowers the pressing member 62 that presses the vicinity of the folding line 'd' of the booklet SA. The pressing member 62 is supported so that it can move up and down along the long groove part 61A of the moving body 61.

Figure 9:
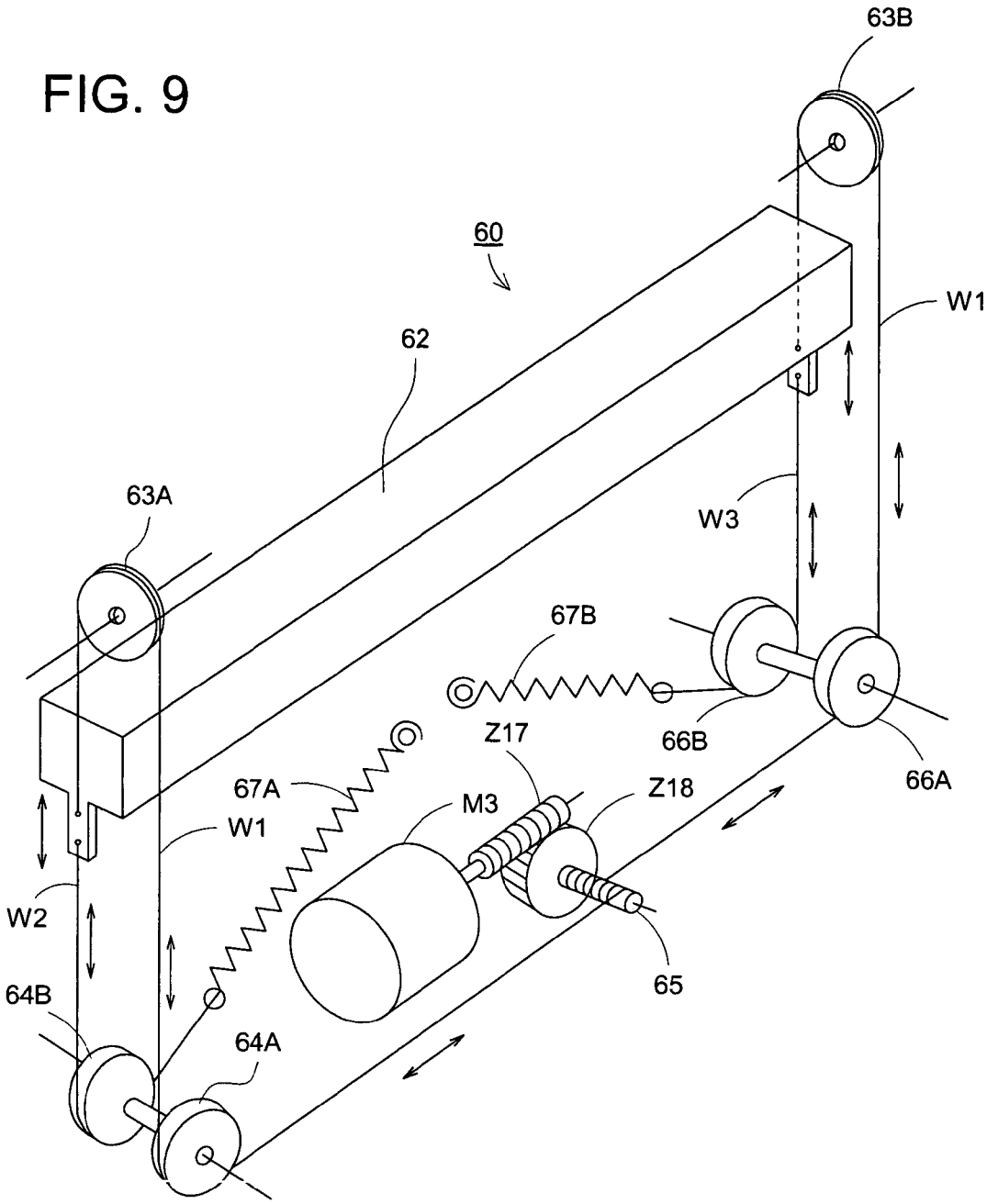
FIG. 9 is a perspective view of the pressing plate ascending and descending drive means.

FIG. 9 is a perspective view of the pressure plate up-and-down drive means that drives up or down the pressing member 62.

The first wire W1 whose one end is connected to the pressing member 62 is passed around slip-wheel 63A, passed around pulley 64A and further wound several times on outer periphery of pulley 65, wound around pulley 66A, wound around slip-wheel 63A and then the other end of wire W1 is fixed to the pressing member 62.

The second wire W2 whose one end is connected to the pressing member 62 is wound around pulley 64B and the other end is connected to spring 67A. The other end of the spring 67A is connected to the body apparatus.

The third wire W3 whose one end is connected to the pressing member 62 is wound around pulley 66B and the other end is connected to spring 67B. The other end of the spring 67B is connected to the body apparatus.

Due to the forward rotation drive of motor M3 causes forward rotation of the pulley 65 via the gears Z17 and Z18, winding up the wire W1 thereby causing the pressing member 62 to be raised via the slip-wheels 63A and 63B.

Due to the reverse rotation drive of motor M3 the pulley 65 rotates in the reverse direction of the wire W1 gets displaced in the reverse direction and it becomes possible to lower the pressing member 62 via the slip-wheels 63A and 63B. The wire W2 connected to the pressing member 62 is pulled by the spring 67A thereby lowering the pressing member 62. At the same time, the wire W3 connected to the pressing member 62 is pulled by the spring 67B thereby lowering the pressing member 62. The neighborhood of the folding line section 'd' of the booklet SA placed on top of the booklet sacking table is pressed due to the lowering of the pressing member 62.

<Booklet Griping and Moving Means>

In FIG. 8, the motor M4 causes linear movement of the pressing member 62 in the booklet transport direction. The driving rotation of motor M4 causes the rotation of drive pulley 68A via the gears Z21, Z22, Z23, Z24, Z25 and Z26. The moving body 61 is connected to the belt 70 going around the drive pulley 68A and the auxiliary pulley 68B. The moving body 61 is supported in a slidable manner by the guide bar 71 mounted on the booklet placement table 50A in a direction parallel to the booklet transport direction. Due to the drive rotation of motor M4, the belt 70 rotates, and the moving body 61 carries out reciprocating motion along the guide bar 71.

<Ascent and descent Moving of the Edge Pressing Member>

Figure 10:
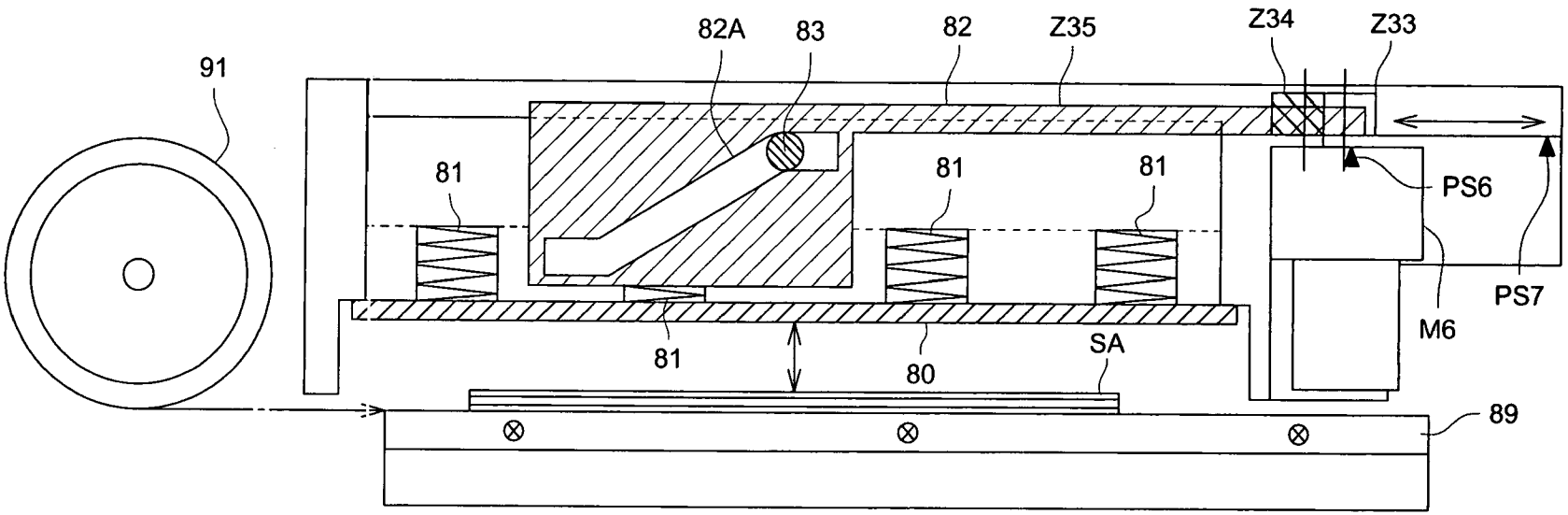
FIG. 10 is a cross-sectional view showing the ascending and descending drive of the edge pressing member.

FIG. 10 is a cross-sectional diagram showing the up-and-down movement of the edge pressing member 80.

The edge pressing member 80 that presses the neighborhood of the edge of the booklet SA is moved-up or down by the cam mechanism and presses the booklet SA by the pressing spring 81. The differences in the thickness of the booklet SA are absorbed by a pleural number of pressing springs 81.

The motor M6 rotates the pinion gear Z34 via the gear Z33 thereby causing linear movement of the moving member 82 that has the rack gear Z35 mating with the pinion gear Z34. The roller 83 incorporated in the edge pressing member 80 mates in a movable manner with the cam grew section 82A built in the moving member 82.

When the cam grew section 82A pushes down the roller 83 due to the linear movement of the moving member 82, the moving member 82 fixed to the roller 83 moves down by a specific length and pushes the booklet SA.

The up-and-down movement of the edge pressing member 80 is restricted by the length and the vertical direction of the cam grew section 82A of the moving member 82. As a consequence, the up and down movement is controlled by the senses PS6 and PS7 detecting the linear movement length of the moving member 82.

<Ascent and descent Movement of the Leading Edge Stopper and Edge Pressing Member>

Figure 11:
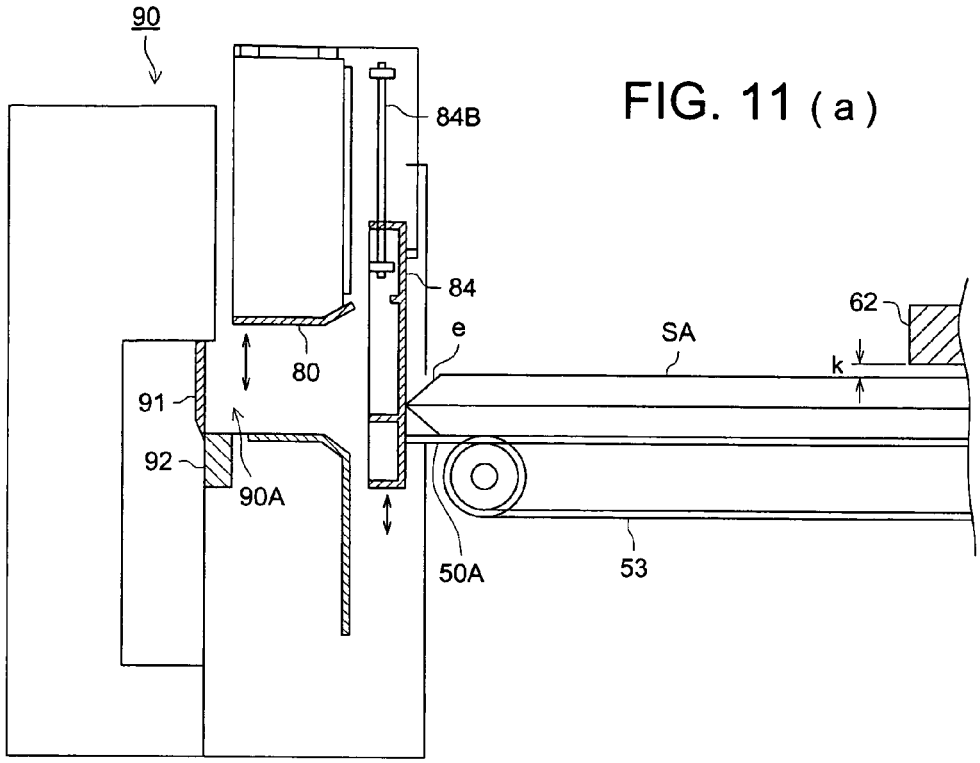
FIGS. 11(*a*) and 11(*b*) are cross-sectional views of the neighborhood of the cutting device.
Figure 11:
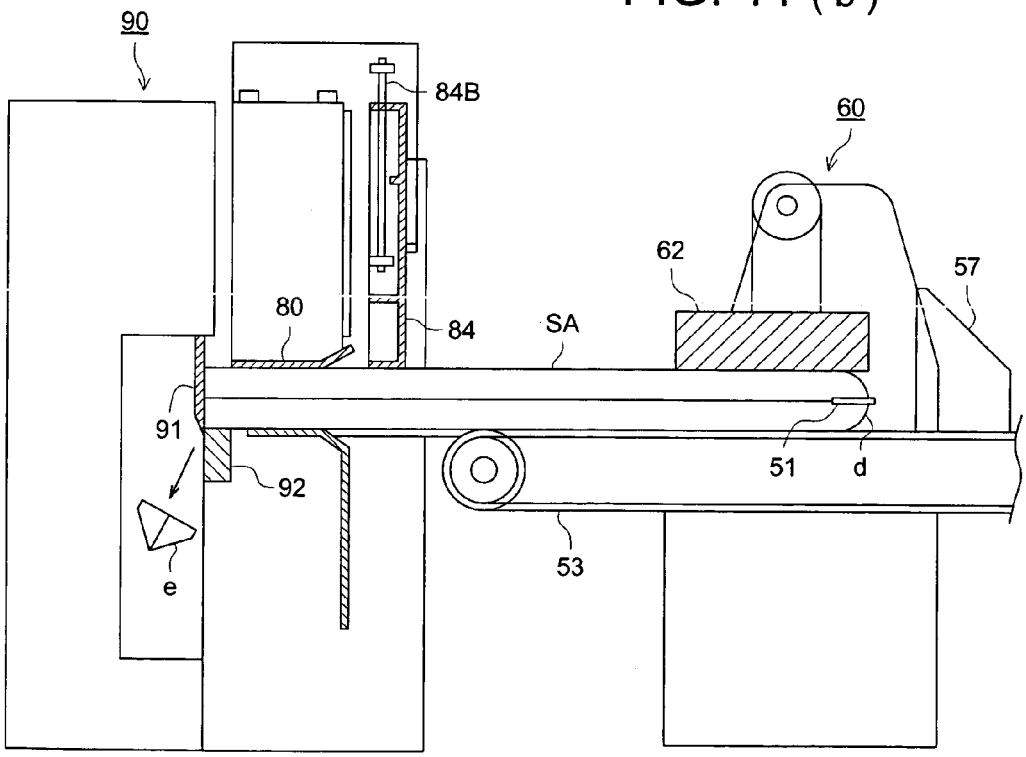

FIGS. 11(*a*) and 11(*b*) show cross-sectional diagram in the neighborhood of cutting device 90 and FIGS. 12(*a*) to 12(*c*) are side view diagrams of the cutting device 90.

FIGS. 11(*a*) and 12(*a*) show the state when the edge 'e' is pushing against the leading edge stopper 84, FIG. 12(*b*) shows the state in which the booklet SA is transported to the opening section 90A of the cutting processing and FIGS. 11(*b*) and 12(*c*) show the condition in which the edge 'e' is cut by the cutting device 90 pressing the neighborhood of the edge of the booklet SA.

The movable member 85 is supported by the swingable manner by the edge pressing member 80 that is moved up and down by the motor M6. The roller 85A supported by the movable member 85 moves along the longitudinal grew section 80A incorporated in the edge pressing member 80 thereby moving the movable member 85 in the vertical direction. The movable member 85 is supported so that it can swing in the up or down direction by the shaft 86A built into the lever 86. The base section of the lever 86 is supported in a swingable manner by the supporting shaft 87. The shaft 87A built into the front end section of the lever 86 moves along the longitudinal groove section 84A of the leading edge stopper 84 thereby raising or lowering the leading edge stopper 84. The lever 86 can move in the vertical direction along the guide bar 84B (see FIGS. 11(*a*) and 11(*b*)).

The single drive source motor M6 not only carries out the up-and-down drive of the edge pressing member 80 but also raises or lowers the leading edge stopper 84 wire the movable member 85 and lever 86. Since, the distance from the supporting shaft 87 to the front end of the lever 86 is longer than the distance from the supporting shaft 87 to the shaft 86A of the edge pressing member 80, up-and-down stroke of the leading edge stopper 84 is larger compared to the edge pressing member 80.

Although, the leading edge stopper 84 is supported so that it can move down either due to its own weight or due to the tension of the spring, after it has passed the front end of the booklet SA it gets lowered coupled with the lowering of the edge pressing member 80 and stops when it comes into contact with the top surface of the booklet SA.

<Cutting Device>

FIG. 13(*a*) shows the front view of the cutting device 90 and FIG. 13(*b*) shows the cross-sectional view of the cutting device 90.

The cutting device 90 includes the rotating upper blade 91 that carries out linear movement along the width direction intersecting the booklet transport direction and rotating at the same time, a fixed lower blade 92 that is fixed along the booklet width direction, a driving means that carries out the linear movement and rotation of the rotating upper blade 91 and the edge pressing member 80 of the neighborhood of the edge of the booklet SA (see FIGS. 12(*a*) to 12(*c*)) etc.

The motor M7 rotates the ball screw installed on the cutting device body 96 via the timing belt 93, and causes linear motion of the rotating upper blade moving body 95 on which is installed the rotating upper blade 91. The rotating upper blade moving body 95 carries out linear motion between the sensor PS4 and the sensor PS5 for detection of initial position.

The rack gear Z31 is fixed to the cutting device body 96 parallel to the rotation center line of the ball screw 94. The pinion gear Z32 placed on the rotating upper blade moving body 95 in a free to rotate manner mates with the rack gear Z31 and is rotated due to the movement of the rotating upper moving body 95. Due to the rotation of the pinion gear Z32, the gear Z27 fixed to the drive transmission shaft 97 holding the pinion gear Z32 rotates and rotating upper blade 91 is rotated via the gears Z28, Z29 and Z30. Therefore, the motor M7 carries out linear movement and rotation of the rotating upper blade 91. The rotating upper blade 91 is fixed to the spring 98 and is kept pressed to the fixed lower blade 92.

Figure 14:
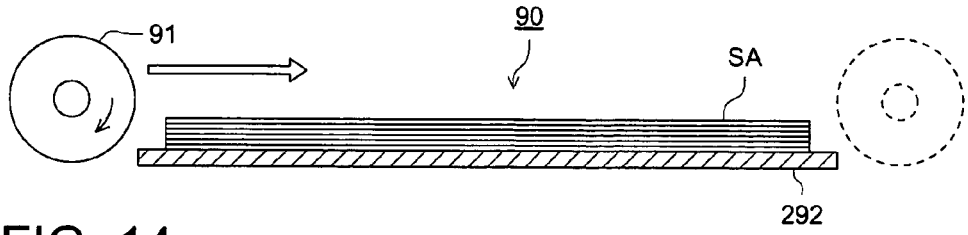
FIGS. 14(*a*)-14(*e*) are cross-sectional views showing examples of different types of cutting devices.
Figure 14:
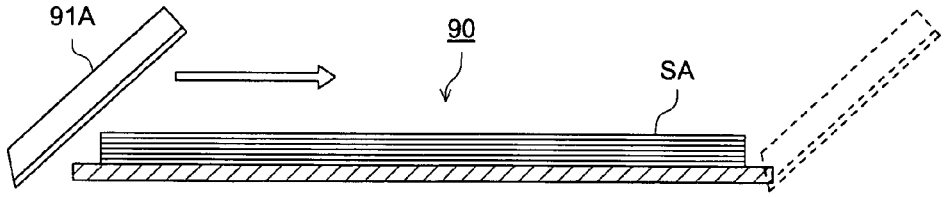
Figure 14:
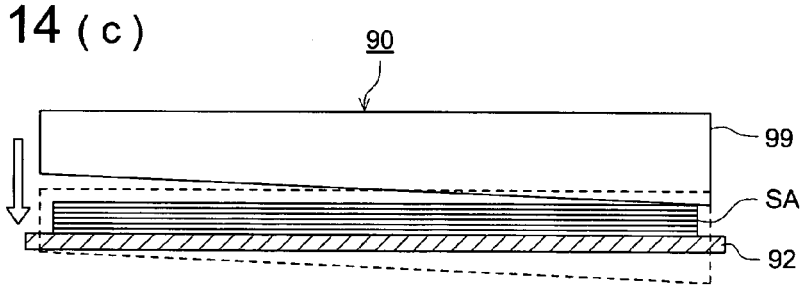
Figure 14:
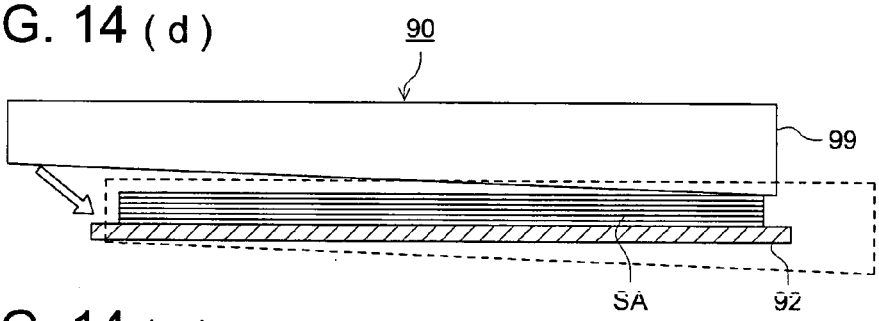
Figure 14:
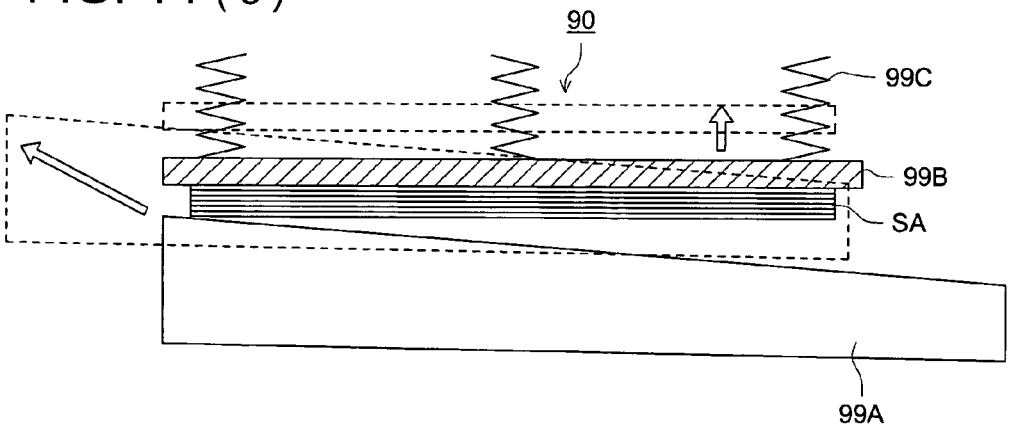

FIGS. 14(*a*) to 14(*e*) are cross sectional diagrams showing examples of various types cutting device 90. In these figures, the cutting blade indicated by bold line correspond to the starting position of cutting and the cutting blade indicated by broken line correspond to the ending position of cutting.

FIG. 14(*a*) shows the cutting device 90 of the rotary cutter type comprising the rotating upper blade 91 and the fixed upper blade 92 described above. The rotating upper blade 91 moves linearly while rotating and mating with the fixed lower blade 92 in the direction of the thick arrow and cuts the edge 'e' of the booklet SA.

FIG. 14(*b*) shows the cutting device 90 in which a straight blade 91A is used in place of the rotating upper blade 91. The straight blade 91A moves linearly in the direction of the thick arrow and cuts the edge 'e' of the booklet SA. It is possible to use an NT cutter (registered trade mark) sold commercially as the straight blade 91A.

FIG. 14(*c*) shows a cutting device 90 comprising a fixed lower blade 92 and a movable upper blade 99. The movable upper blade 99 having an inclination mates with the fixed lower blade 92 and moves down linearly in the direction of the thick arrow and cuts the edge 'e' of the booklet SA from one end to the other.

FIG. 14(*d*) shows another example of cutting device 90 comprising a fixed lower blade 92 and a movable upper blade 99. The movable upper blade 99 having an inclination mates with the fixed lower blade 92 and moves down linearly in the direction of the thick arrow and cuts the edge 'e' of the booklet SA from one end to the other.

FIG. 14(*e*) shows yet another example of cutting device 90. The movable lower blade 99A having an inclination moves up at an inclined angle and cuts the edge 'e' of the booklet SA from one end to the other. The receiving plate 99B shaped like a cutting board that supports the top surface of the booklet SA receives the blade edge of the movable lower blade 99A with support from spring 99C.

Figure 15:
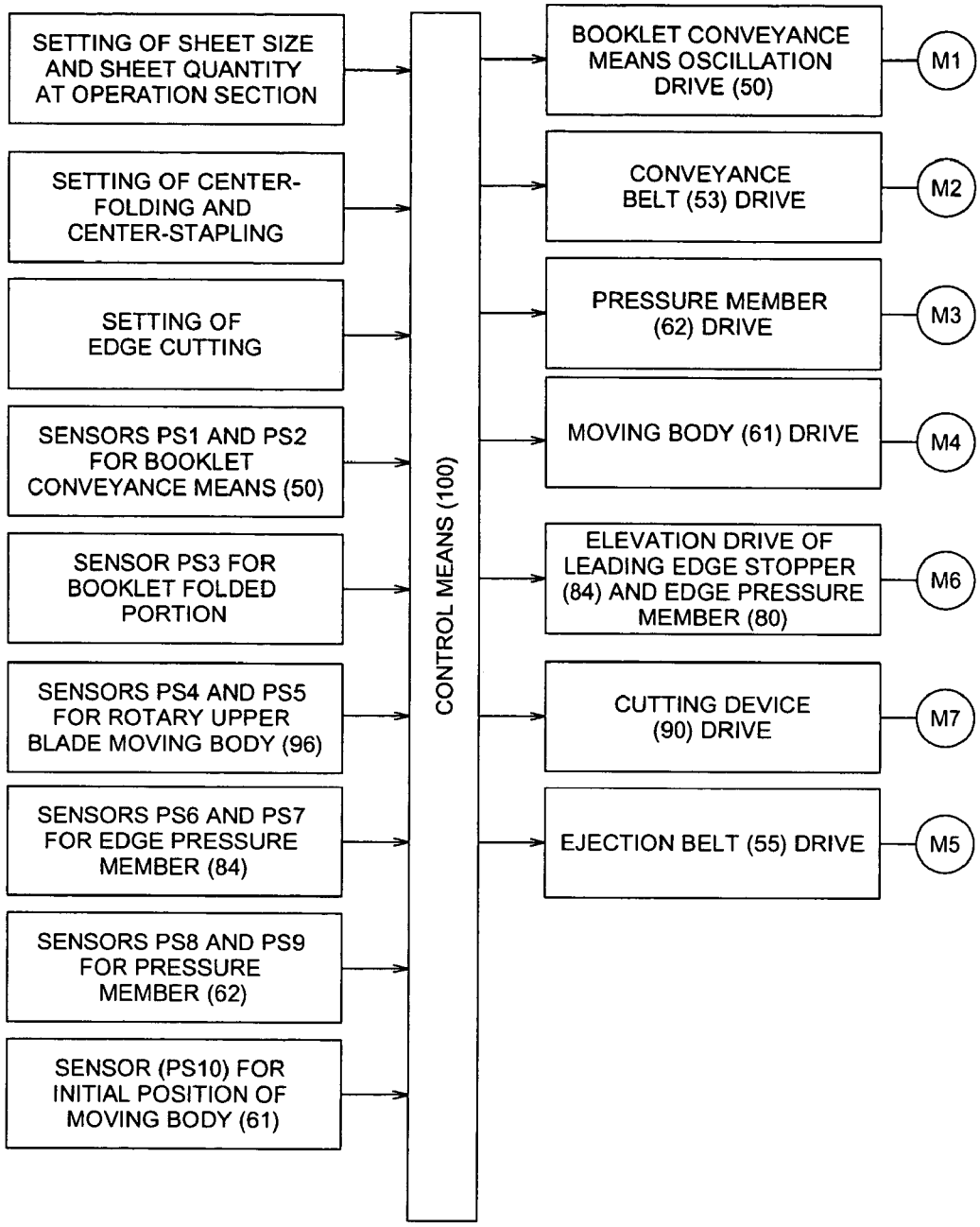
FIG. 15 is a block diagram showing the control of the sheet finisher.
Figure 16:
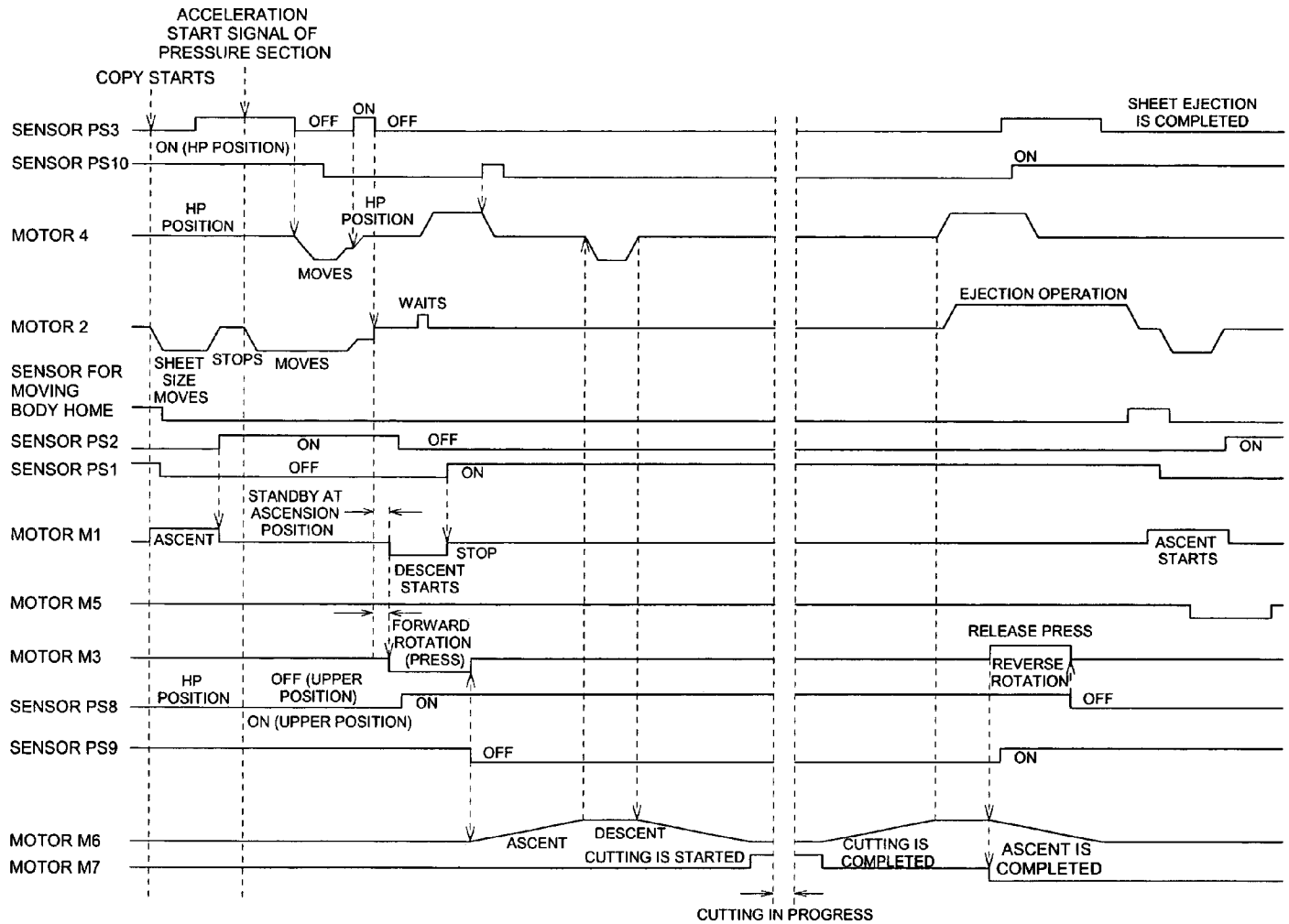
FIGS. 16(*a*)-16(*n*) are various time charts showing the control of the sheet finisher.

First Preferred Embodiment of Booklet Skew Correction Process and Cutting Process FIG. 15 shows a block diagram of the control of the sheet finisher B. FIGS. 16(*a*) to 16(*n*) show the time charts of the control of the sheet finisher B.

When the sheet size and the number of sheets are set in the operation section A and further the center-folding and center-stapling processes and the edge cutting process are selected, the control means 100 controls the drives of transport belt 53, discharge belt 55, moving body 61, pressing member 62, front edge stapler 84, edge pressing member 80 and the cutting device 90 of the sheet finisher B. The sensors PS1 to PS7 detect the positions of various members of the sheet finisher B and of the booklet SA and transmit the detection signals to the control means 100.

FIGS. 17 to 21 show the cross-sectional diagrams of the states of transporting the book SA that has been prepared by center-folding and center-stapling, and sending-to the cutting device 90 after correcting its skew.

(1) The motor M1 starts the drive upon receiving the copy start signal and raises one end of the booklet transport means 50 comprising the booklet placement table 50A and the transport belt 53. The sensor PS1 detects the initial position of the booklet placement table 50A. When the sensor PS1 detects the upper limit position of the rising booklet placement table 50A the drive of the motor M1 stops and the booklet transport means 50 waits at the upper limit position.

Figure 17:
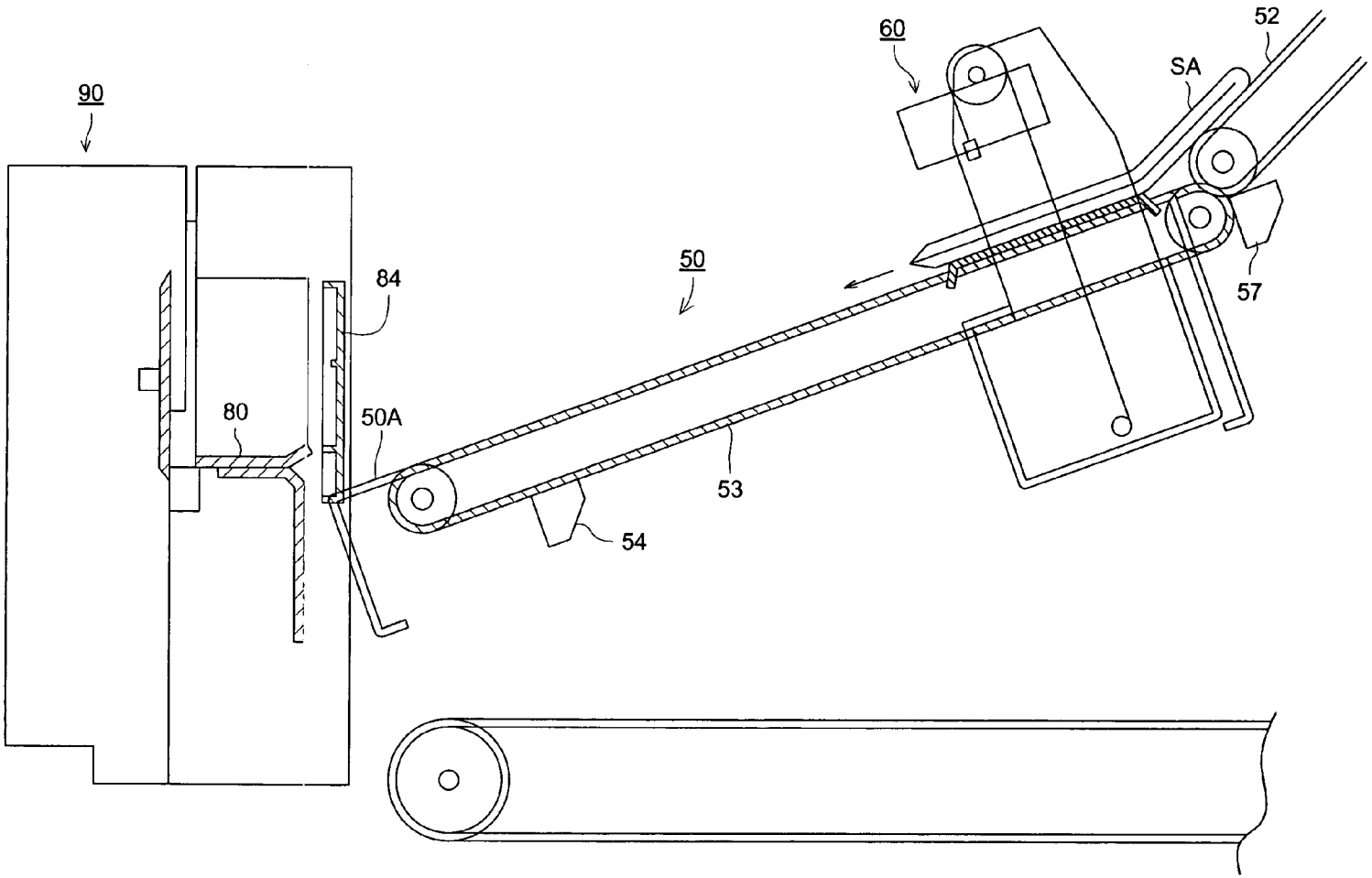
FIG. 17 is a cross-sectional view of the booklet transporting means held in an inclined position and of the cutting device.

(2) FIG. 17 is a cross-sectional diagram of the booklet transport means 50 maintained in an inclined position and of the cutting device 90.

The drive of the motor M2 starts upon receiving the copy start signal, the transport belt 53 starts rotating and the movable alignment member 54 moves to and stops at a specific position corresponding to the sheet size. The booklet SA sliding down on the transport belt 52, which is placed in an inclined position is transferred on to the booklet placement table 50A held in the inclined position with the edge 'e' at the front.

Figure 18:
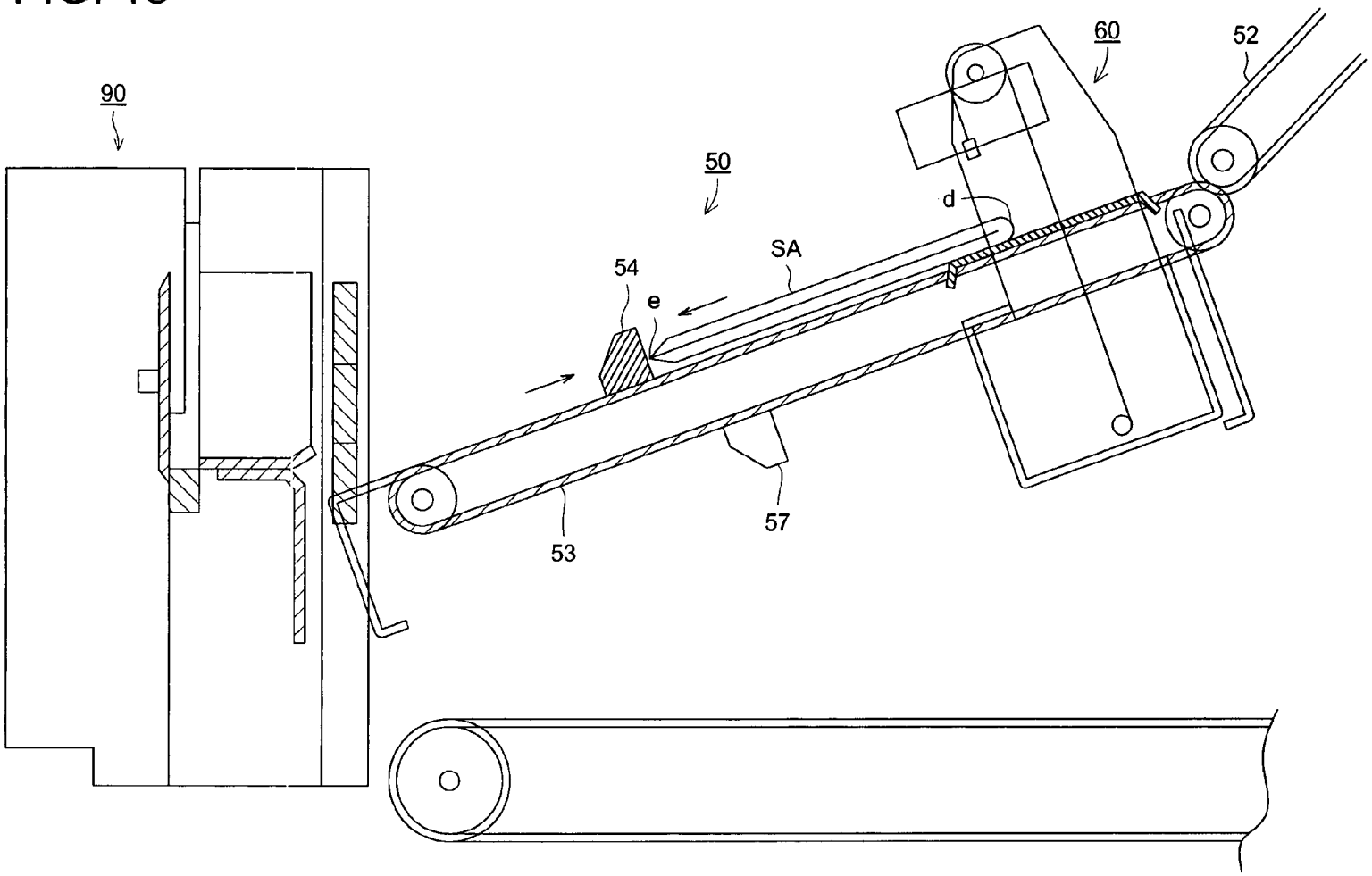
FIG. 18 is a cross-sectional view showing the condition of transporting the booklet.
Figure 19:
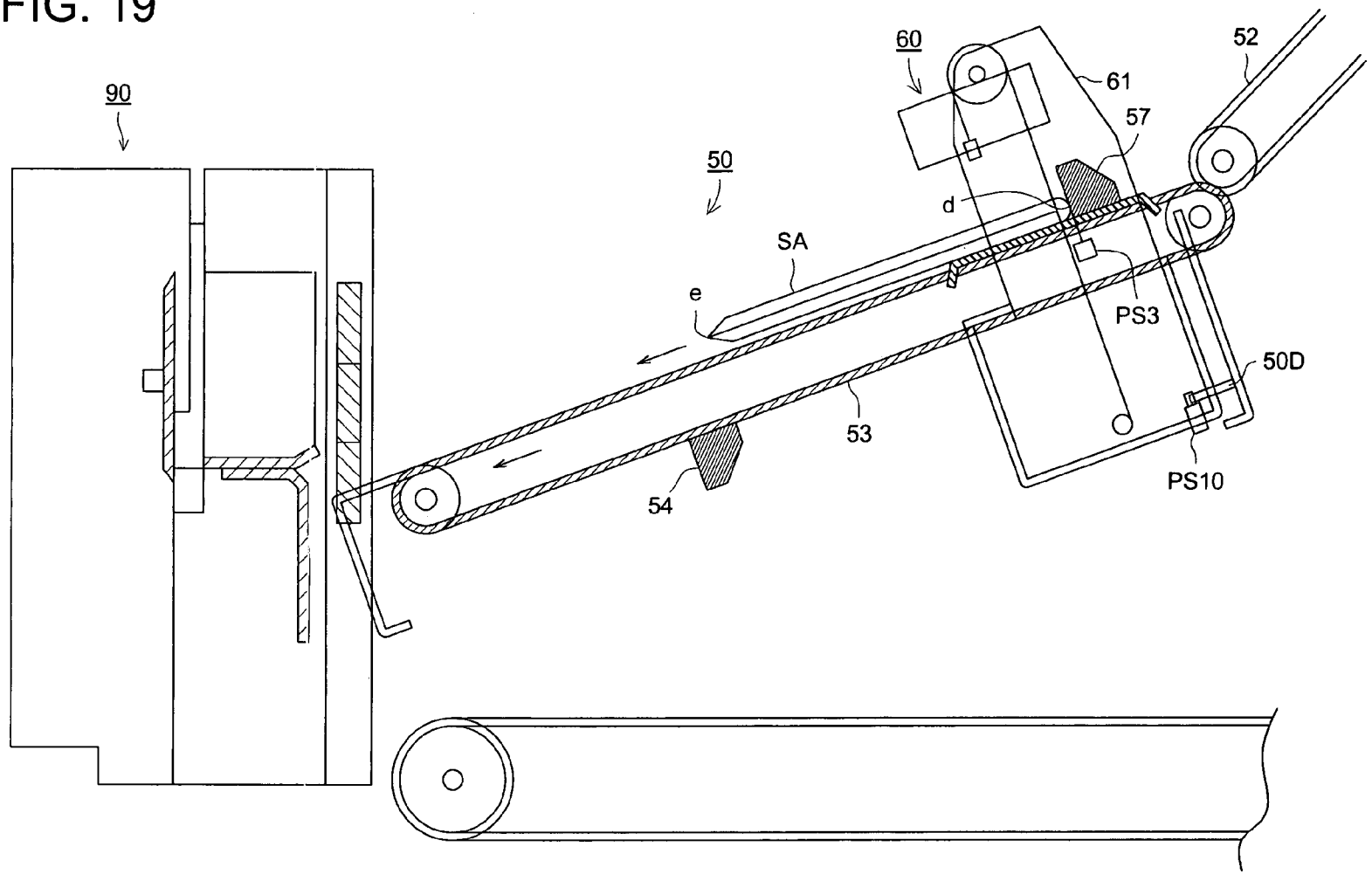
FIG. 19 is a cross-sectional view showing the condition of transporting the booklet.

(3) FIG. 18 and FIG. 19 are cross-sectional diagrams showing the state of transporting the booklet SA by the booklet transport means 50 held in an inclined position.

The drive of the motor M2 is started again upon receiving the press section acceleration start signal, the transport belt 53 starts rotating, the movable alignment member 54 holding the front end of the booklet SA (edge 'e') moves downward in an inclined direction, and also the aligning member 57 fixed to the transport belt 53 presses the back end (the folding line part 'd') of the booklet SA and transfers the booklet with its edge 'e' at the front on to the placement table 50A held in an inclined position, and the booklet stops when the front end along the direction of movement of the edge 'e' of the booklet SA comes into contact with the leading edge stopper 84.

(4) When a specific time interval has elapsed, after the passage of the folding section 'd' of the booklet SA transported over the booklet placement table 50A is detected by the sensor PS3 (detector), the motor M4 is driven to start the movement of the moving body 61 of the booklet gripping and conveying means 60, which is stopped at a specific location and then returned to the home position (reference position).

The home position of the booklet gripping and conveying-means 60 is the position at which the detection light path of the sensor PS10 fixed in the neighborhood of the bottom of the moving body 61 is cutoff by the light shutoff plate 50D fixed near the bottom part of the booklet placement table 50A. Further, a sensor of the light reflecting type, light transmitting type and light shutoff type using an actuator can be used as the sensor PS3 installed at a specific location of the moving body 61.

Figure 20:
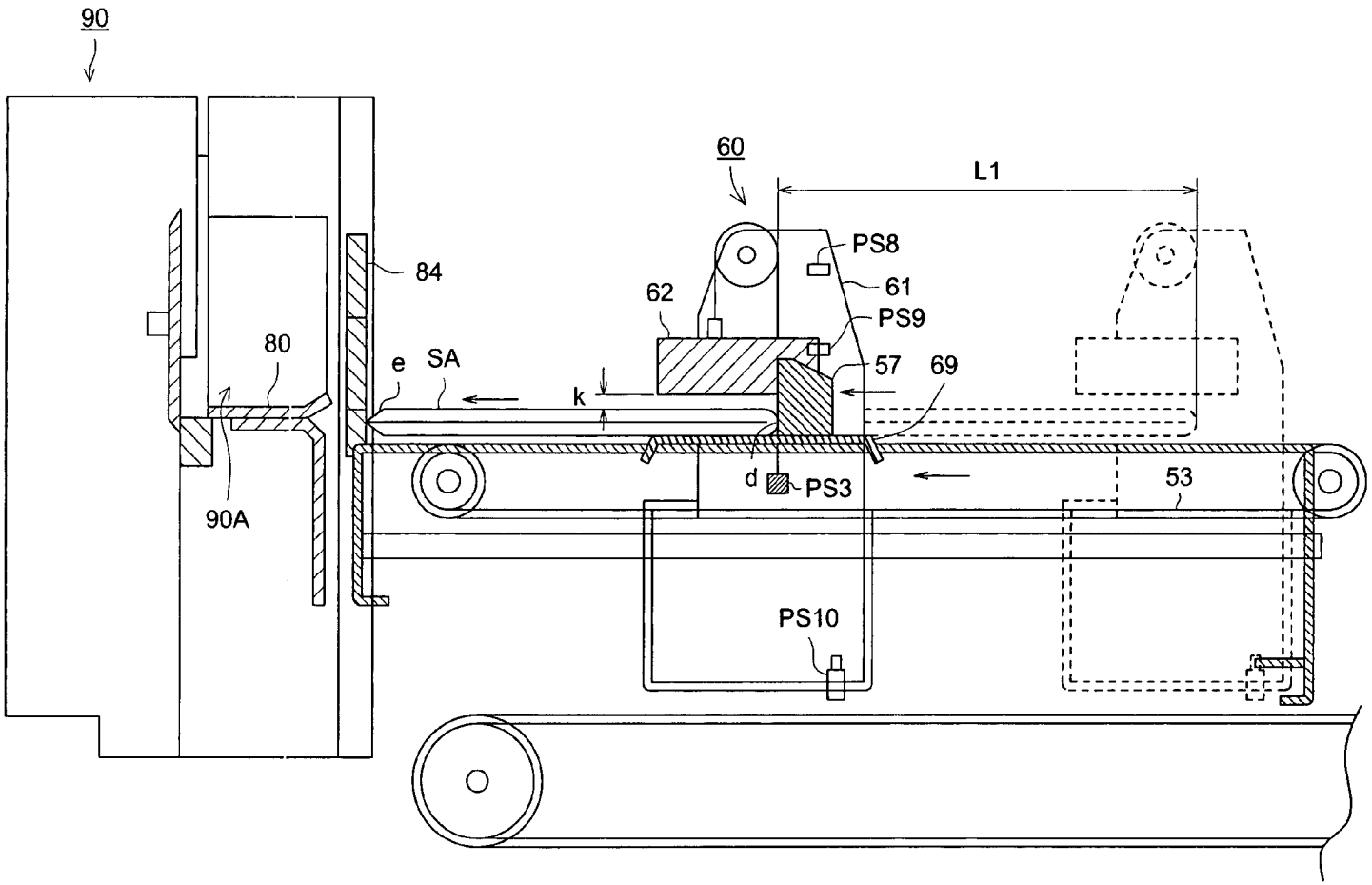
FIG. 20 is a cross-sectional view showing the condition of correcting the skew in the booklet while maintaining the booklet transporting means in the horizontal state.

(5) FIG. 20 is a cross-sectional diagram showing the state of carrying out belt correction of the booklet SA, while maintaining the booklet transport means 50 in the horizontal condition.

After the detection signal from the sensor PS3 goes off, the swinging movement of lowering the booklet transport means 50 towards the upstream side of the booklet transport is started by driving the motor M1, and the swinging movement of the booklet transport means 50 is stopped when the sensor PS1 detects that it has gone into the horizontal state.

(6) The motor M4 is driven again to restart the movement of the moving body 61 and the drive of the motor M4 is stopped when the moving body 61 shifts from the home position (reference position) and the sensor PS3 (detector) detects the folding line part 'd' of the booklet SA.

(7) The drive of the motor M3 is started at the same time as the start of the swinging motion of the booklet transport means 50, the pressing member 62 of the booklet gripping and conveying means 60 is lowered and the bulge near the folding line part 'd' if the booklet SA is flattened by pressing down. The motor M4 is driven in the reverse direction while the pressing member 62 is down, the transport belt 53 is rotated in the reverse direction thereby withdrawing the alignment member 57 from the position of its contact with the folding line part 'd' of the booklet SA, and then the booklet SA is pressed by the pressing member 62.

(8) By driving the motor M3, the pressing member 62 is raised to a specific amount thereby creating a small spacing 'k' (see FIG. 20) between the top surface of the booklet SA and the bottom surface of the pressing member 62.

(9) By driving the motor M2, the transport belt 53 is rotated in the direction of the arrow thereby moving the alignment member 57 fixed to the transport belt 53 and making it come into contact with the folding line part 'd' of booklet SA making the edge 'e' of the booklet SA push against the leading edge stopper 84 which has stopped at the lower position, thereby correcting any skew in the booklet SA (see FIG. 11(*a*) and FIG. 20).

Figure 21:
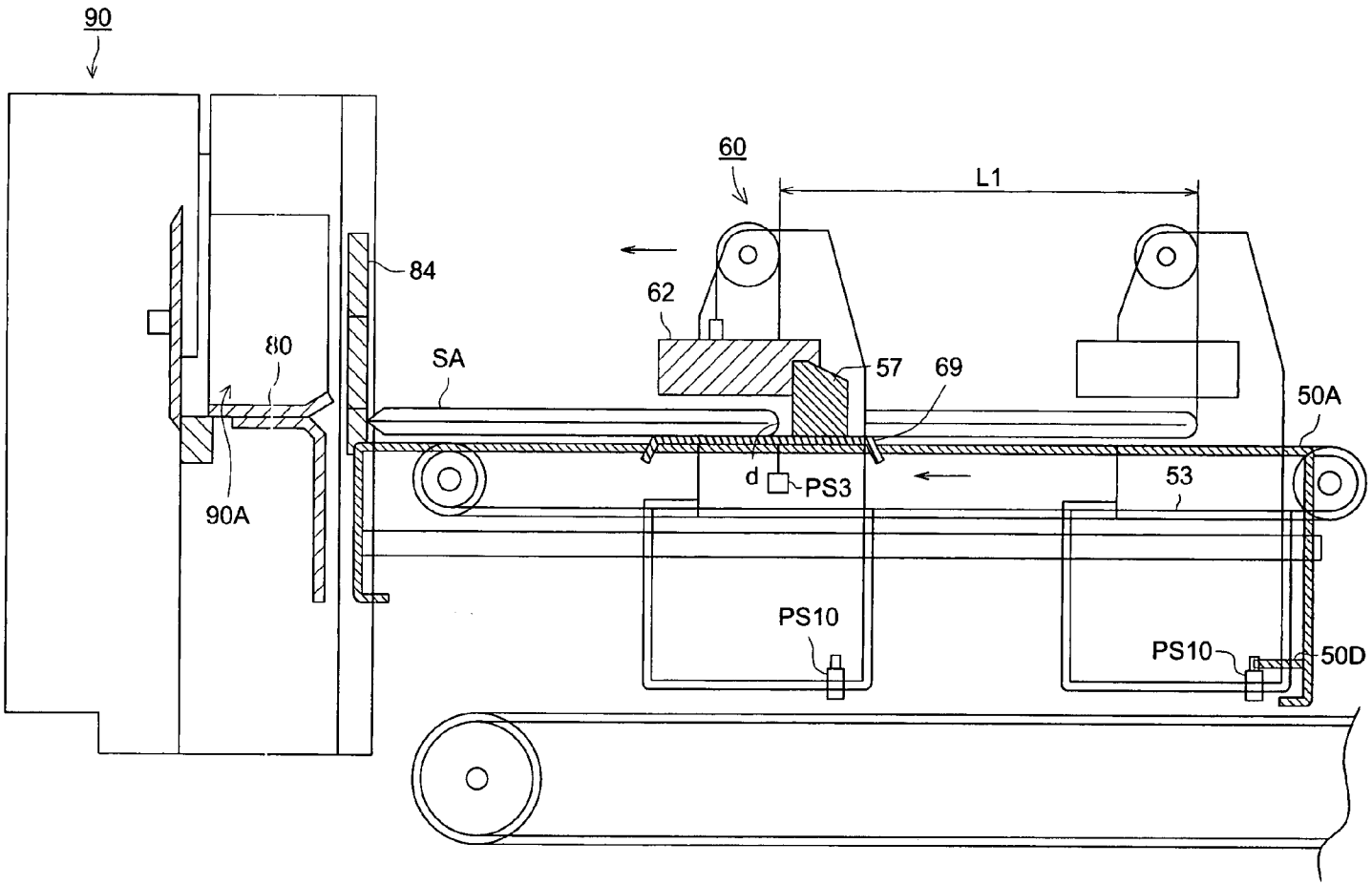
FIG. 21 is s cross-sectional view showing the condition in which the booklet is gripped by the booklet gripping and conveying means.

(10) FIG. 21 is a cross-sectional diagram showing the state in which the booklet SA is gripped by the booklet gripping and conveying means 60.

After the skew in the booklet SA is corrected, the motor M2 is driven in the reverse direction, the transport belt 53 is rotated in the reverse direction, after the alignment member 57 is returned slightly towards the up-stream side of the transport path, the motor M3 is driven, the pressing member 62 is lowered, and the booklet SA is gripped by pressing near the folding line part 'd' of the booklet SA on the booklet supporting plate 69.

The distance of returning the alignment member 57 along the transport path is set to a distance that does not cause interference with the aligning member 57 of the folding line part 'd' of the booklet SA moving towards the up-stream side of the transport path at the time when the bulge in the booklet SA is flattened by being pressed by the pressing member 62.

(11) After the lowering of the pressing member 62 is started and sensor PS8 positioned at the top part of the booklet gripping and conveying means 60 for detecting the home position changes its state from OFF to ON, the drive of the motor M3 is stopped by the signal of the sensor PS9 positioned at the lower part of the booklet gripping and conveying means 60 becoming OFF, thereby maintaining the pressing by the pressing member 62 in the stopped state. Further, the drive of the motor M6 is started at the same time as when the sensor PS9 goes OFF thereby raising the leading edge stopper 84 and the edge pressing member 80.

(12) After correcting the skew in the booklet SA; the pressing member 62 is lowered again by driving motor M3, the pressing member 62 is lowered, and the booklet SA is gripped by pressing near the folding line part 'd' of the booklet SA on the booklet supporting plate 69.

Figure 22:
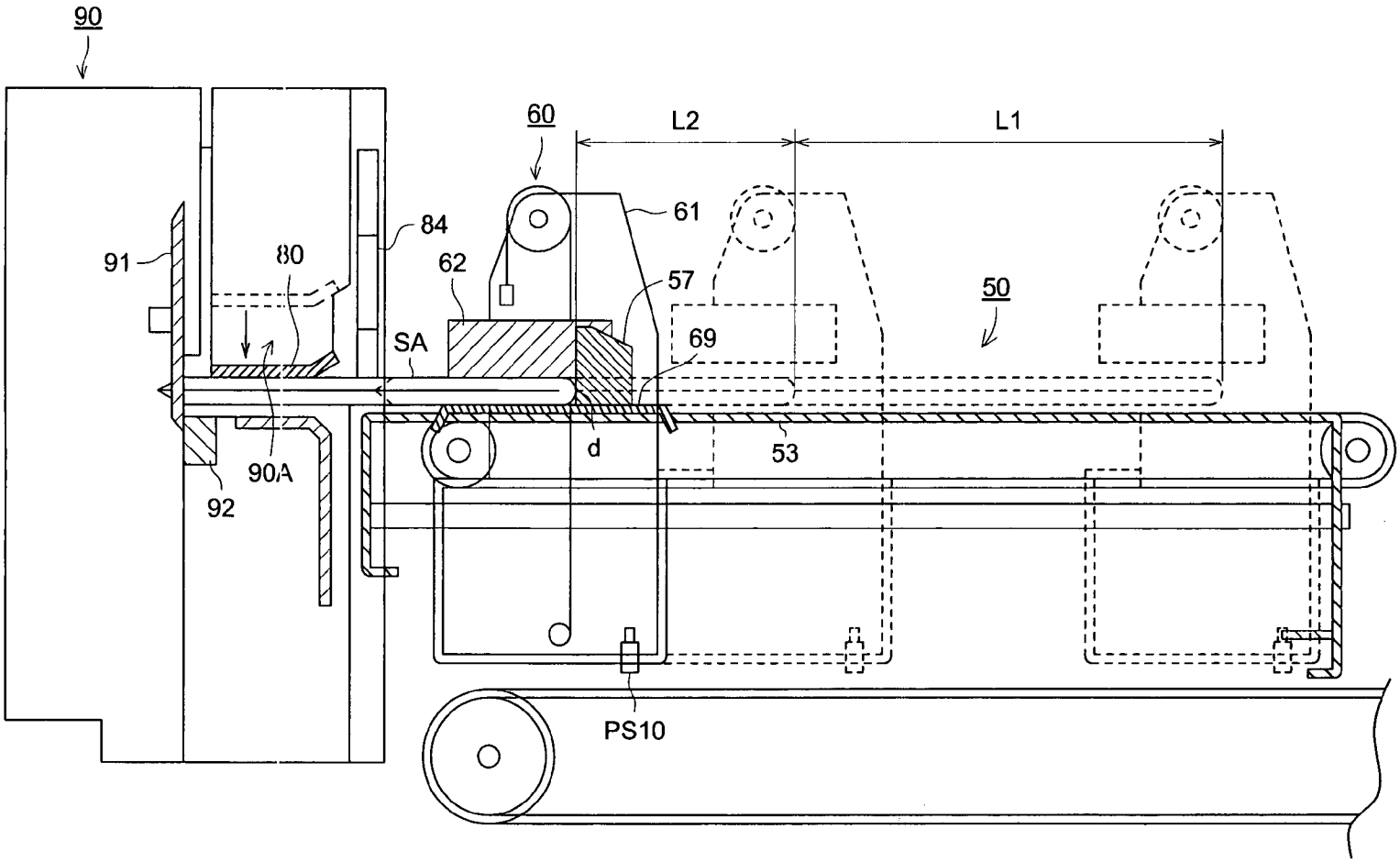
FIG. 22 is a cross-sectional view showing the condition of transporting the booklet to the cutting process opening section and cutting the edge.

(13) FIG. 22 is a cross-sectional diagram showing the state of transporting the booklet SA to the opening section 90A of the cutting process and cutting edge.

By driving the motor M6, the leading edge stopper 84 and the edge pressing member 80 are withdrawn in the upward direction thereby putting the opening section 90A of the cutting process in the open state.

(14) By driving the motor M4 and making the booklet and moving means 60 move in the leftward direction shown in the figure, the movement is made while gripping the booklet by the aligning member 57 and the booklet supporting plate 69, the front end part of the booklet is passed through the opening section 90A of the cutting process. The booklet gripping and conveying means 60 stops at a specific position corresponding to the sheet size. With this, the booklet SA is stopped at the cutting position.

(15) By driving the motor M6, the edge pressing member 80 is lowered pressing the booklet SA near the edge thereby flattening it.

(16) By driving the motor M7, the rotating upper blade 91 is made to move along the width direction of the booklet SA, and cuts the edge of the booklet SA in combination of the fixed lower blade 92 (see FIG. 22 and FIG. 11(*b*)).

During the booklet transport process, the control means 100 moves the booklet gripping and conveying means 60 from the home position by a distance L1 until the sensor PS3 detects the end on the folding line side of the booklet SA and stops at the position at which the end is detected. Subsequently, after gripping the booklet SA by pressing its top surface by the pressing member 62, the booklet gripping and conveying means 60 is moved by a distance L2 up to the position at which the amount of cutting of booklet by the cutting device 90 becomes equal to a specific cutting amount. Because of this the booklet SA stops at a cutting position so that the size becomes constant for different sheet sizes, in other words, stops at a cutting position so that the length from the folding line section to the cutting section becomes constant.

The distance L1 of movement of the booklet gripping and conveying means 60 from the home position (reference position) to the temporary stop position varies depending on half the length of the sheet along the longitude direction, that is, the length of the booklet SA from the edge 'e' to the folding line part 'd', on the number of pages in the book, and on the sheet thickness. In order to make the size of the booklet SA constant for each sheet size irrespective of the number of sheets of paper, the value of the sum of the movement distance L1 and the movement distance L2 is made constant for each sheet size. However, even when the sheet size is the same, since the amount of variation on the edge side and the thickness of the folding line side varies depending on the number of sheets or the sheet thickness, the distance L1 of movement of the booklet gripping and conveying means 60 up to the temporary stop position varies depending on the number of sheets or the sheet thickness. Therefore, considering this amount of variation, it is necessary to control the distance L2 of movement for transporting the booklet SA up to the cutting position. In addition, while it is also possible to carry out control to suit the sheet thickness based on the dimensions obtained by measuring the actual thickness, it is possible to simplify the control or the mechanism by carrying it out based on the type of sheet set by the user.

(Other Preferred Embodiments of the Booklet SA Folding Line Detection Means)

FIGS. 23(*a*) to 23(*c*) show the cross-sectional diagrams of the other preferred embodiments of the booklet SA folding line detection means.

Although it is possible to use light reflecting type sensors and light transmitting type sensors for the sensors PS3 of the booklet SA folding line detection means, there will be fluctuations in the folding line detection accuracy in these optical sensors.

Further, when the detection surface of the sensors is placed facing up, since detection defects can occur due to the detection surface being covered by sheet dust etc. generated during booklet transportation, these sensors are not appropriate for accurately detecting the position of the folding line part 'd' of the booklet SA. In addition, since the pressing member 62 that can move up and down is placed on the top surface of the booklet SA, it is not possible to place the sensor PS3 here.

Figure 24:
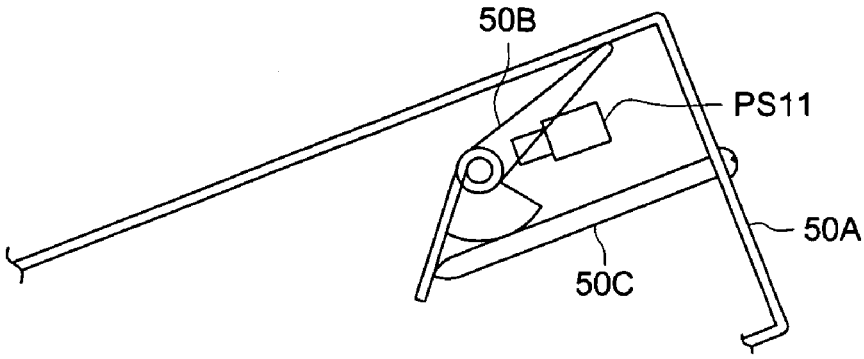
FIGS. 24(*a*) and 24(*b*) are cross-sectional views showing the operation of the optical detection means in the booklet reception process and in the booklet alignment process.
Figure 24:
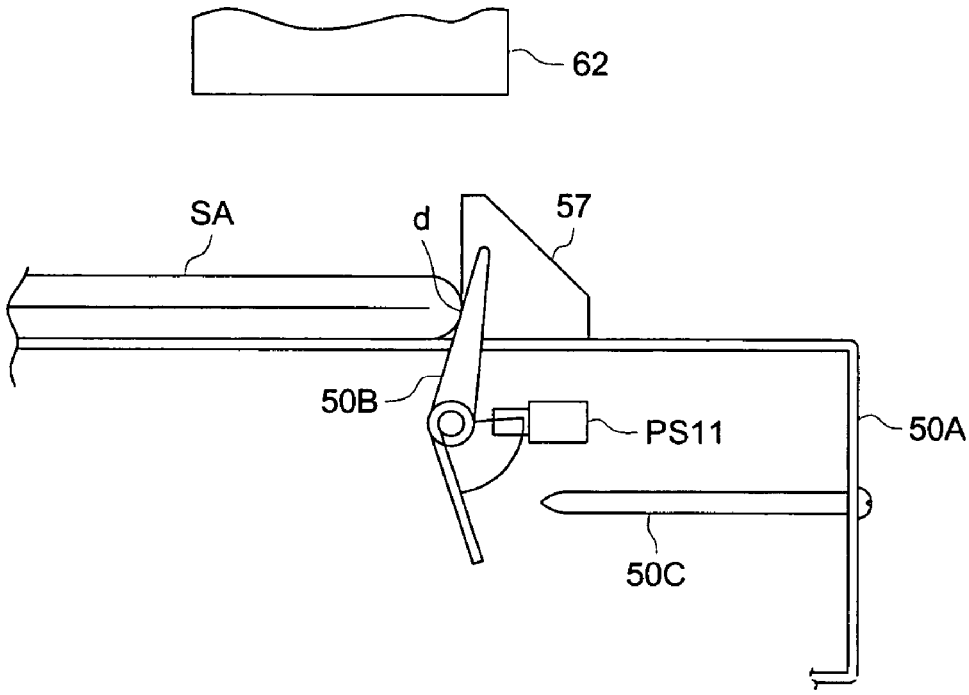

FIGS. 23(*a*) to 23(*c*) are cross-sectional diagrams showing other preferred embodiments of the booklet SA folding line detection means. FIG. 23(*a*) shows the booklet acceptance state, FIG. 23(*b*) shows the booklet alignment process and FIG. 23(*c*) shows the booklet cutting process. FIGS. 24(*a*) and 24(*b*) are cross-sectional diagrams showing the operation of the light detection means wherein FIG. 24(*a*) shows the booklet acceptance process and FIG. 24(*b*) shows the booklet alignment process.

The photo-interrupter type optical sensor PS11 and actuator 50B making it possible to cut off the detection light path of the optical sensor PS11 are supported in a swingable manner by the moving body 61 of the booklet gripping and conveying means 60. The pushing rod 50C is fixed to the bottom of the booklet placement table 50A on the downward side of the booklet transport direction.

When the booklet gripping and conveying means position is in the home position, the tip of the pushing rod 50C pushes against the rear end of the actuator 50B swings it into the fallen state, and the front end of the actuator 50B is maintained in a state in which it is submerged below the booklet transport surface of the booklet placement table 50A, whereupon the optical sensor PS11 goes off going into the non-detection state.

When the booklet gripping and conveying means 60 moves from the home position towards the down-stream side of the booklet transport direction, the rear end of the actuator 50B supported by the moving body of the booklet gripping and conveying means 60 get separated from the tip of the pushing rod 50C, the front end of the actuator 50B goes into the standing position because of the action of the spring, due to the forward movement of the booklet gripping and conveying means 60, the front end of the actuator 50B pushes against the folding line part 'd' of the booklet SA and the optical sensor PS11 detects the stopping position of the folding line part 'd' of the booklet SA thereby going into the detection state.

In this manner by detecting the stopping position of the folding line part 'd' of the booklet SA using the detection means comprising the actuator 50B and the optical sensor PS11, it is possible to detect the position of the booklet SA without any need for complicated mechanism or timing control as in conventional methods, thereby making it possible to carry out complete correction of skew in the booklet SA and to carry out the correct edge cutting.

(Second Preferred Embodiment of the Booklet Skews Correction Process and Cutting Process)

After the booklet gripping and conveying means 60 is moved by a distance L1 from the home position to the position at which the part 'd' of the booklet SA on the folding line side is detected, the control means 100 returns the booklet gripping and conveying means 60 to the home position (reference position). Next, the booklet gripping and conveying means 60 is moved again, the booklet gripping and conveying means 60 is moved by the specific distance L1+L2 so that transporting the booklet SA up to the cutting position in order to make the size of the booklet becomes constant for each sheet size.

After pressing the booklet SA by the booklet gripping and conveying means 60, by returning once to the home position (reference position), it is possible to set so that the booklet-gripping and conveying means 60 is moved by constant distance from the home position up to the cutting position of the cutting device 90, whereby it is possible to eliminate errors in the cutting dimensions due to errors in the drive of the drive means such as a stepping motor and to carry out stable cutting operation.

(Booklet Discharging Process)

Figure 25:
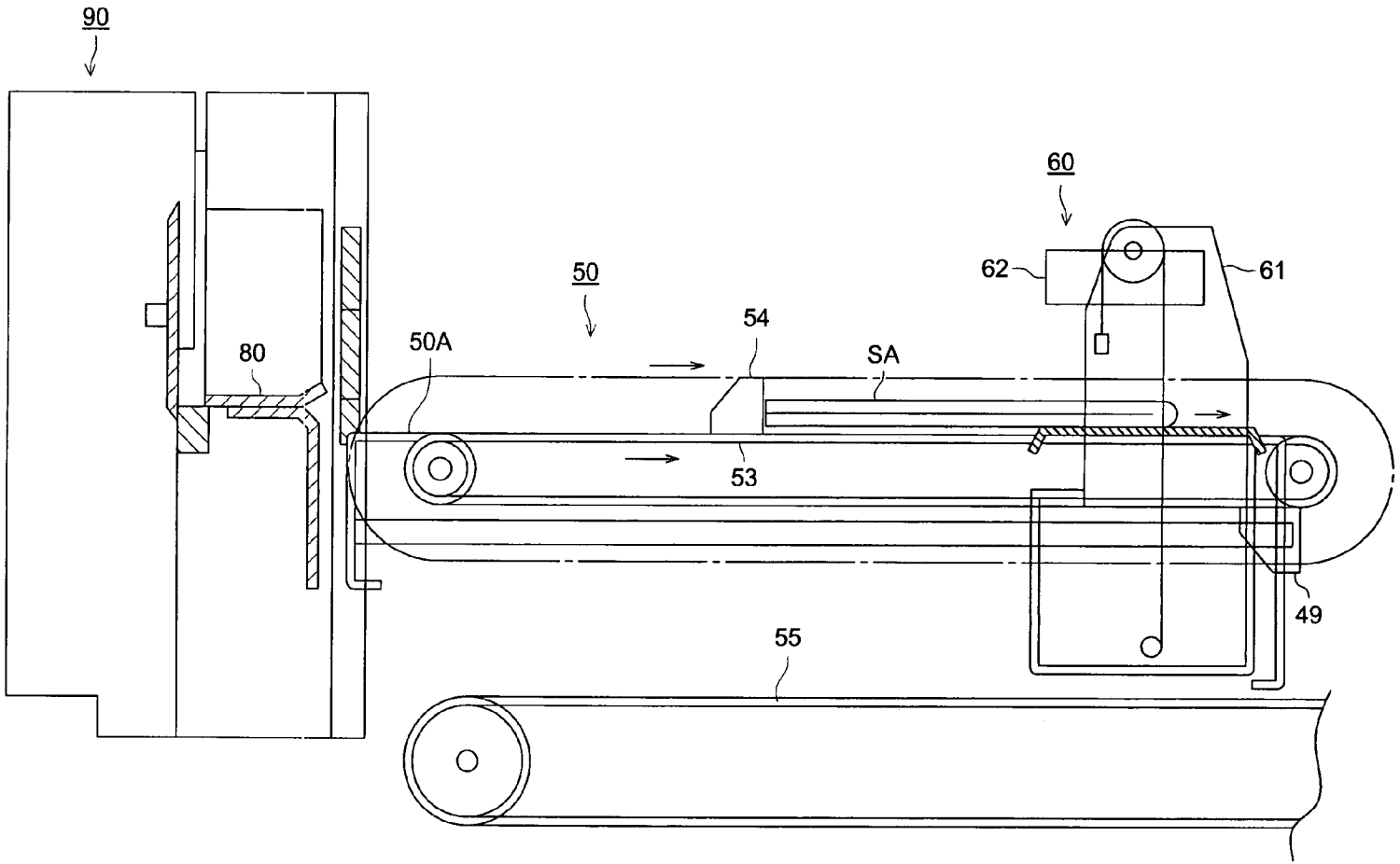
FIG. 25 is a cross-sectional view showing the condition of discharging a booklet that has been cut.
Figure 26:
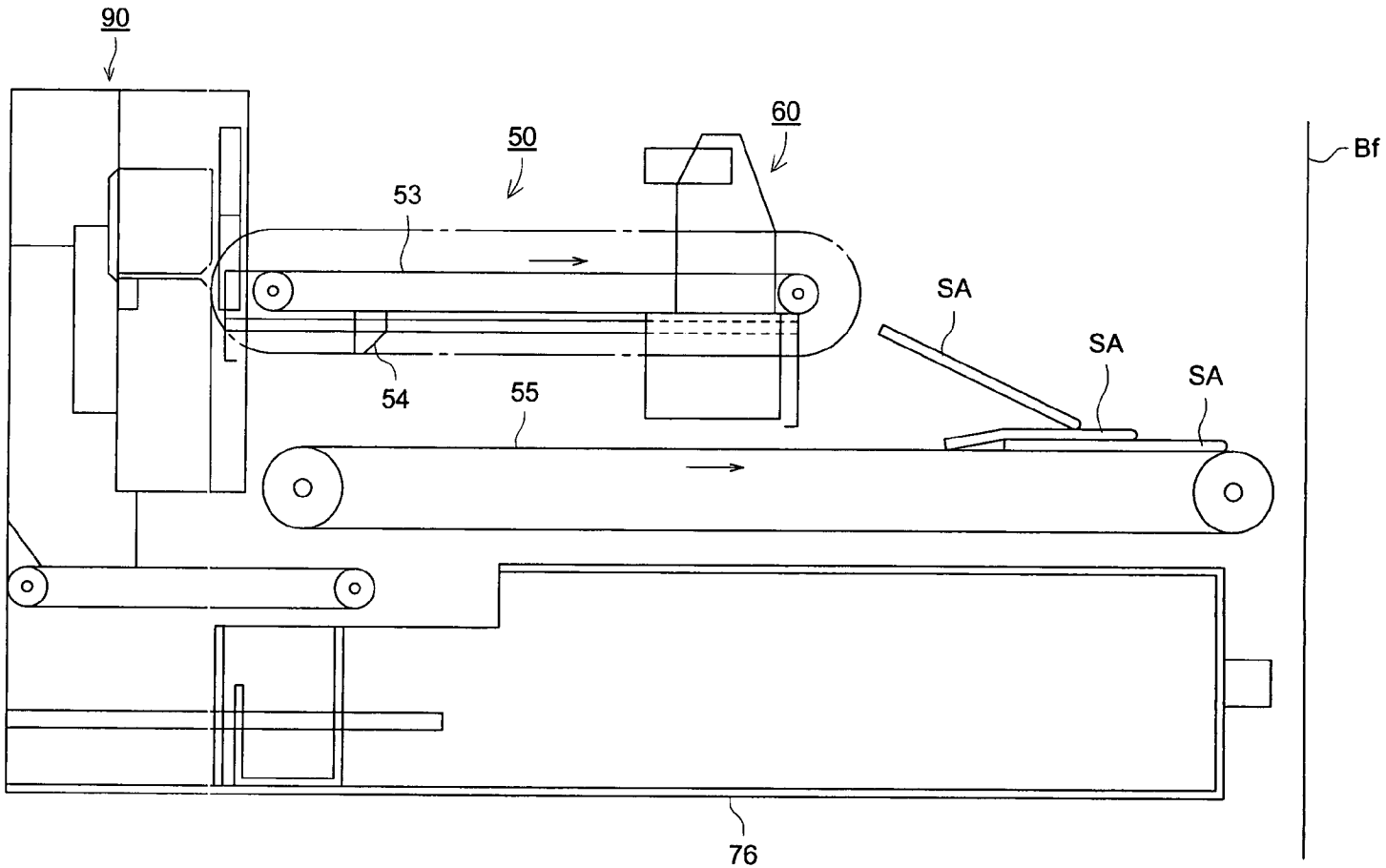
FIG. 26 is a cross-sectional view showing the condition of discharging a booklet that has been cut.

FIG. 25 and FIG. 26 are cross-sectional views showing the state in which the cut booklet SA is discharged.

(1A) After the cutting process the pressure of the edge pressing member 80 is released by driving the motor M6, the booklet is moved towards the right shown in the figure while keeping the pressing 62 pressing near the folding line part 'd' by driving the motor M3.

(2A) When the edge 'e' of the booklet SA passes above the position of center of rotation of the drive roller rotation shaft 53A that rotates the transport belt 53, the pressure of the pressing member 62 is released by driving the motor M3 and by driving next the motor M2, the transport belt 53 is rotated in the forward direction, the movable alignment member 54 fixed to the transport belt 53 is made to press against the edge 'e' of the booklet SA thereby moving it above the booklet placement table 50A in the discharging direction (see FIG. 25).

(3A) When the edge 'e' of the booklet SA passes the swiveling position of the movable alignment member 54 near the right end shown in the figure of the transport belt 53, the booklet SA is pushed by the movable alignment member 54 and falls down from the top of the booklet placement table 50A. The following booklet SA is discharged above the rotating discharge belt 55 and is piled up on the top surface of the previous booklet SA (see FIG. 26). The booklet SA can be taken out by opening the door at the front Bf of the sheet finisher B.

Further, although a sheet finisher B containing center-folding and center-stapling mechanisms and connected to the image forming apparatus A has been described in the preferred embodiments of the present invention, it is possible to carry out in a sequence multipurpose and multifunction finishing by selectively connecting the sheet finisher provided with a sheet folding apparatus according to the present invention to a sheet finisher carrying out center-folding after initially carrying out center-stapling, or to a binding apparatus connected to a light printing machine.

Further, the present invention can also be applied for a sheet finisher that is used by connecting to a light printing machine, printer, facsimile, all in one unit, or other image forming apparatus.

In addition, it is also possible to realize various types of folding processes as a sheet finisher in the stand-alone mode separating from an image forming apparatus.

What is claimed is:

1. A finisher for finishing a booklet having a bundle of center-folded sheets, comprising:

(a) a detector for detecting an end on a side of a folded portion of the booklet;

(b) a moving device, which has a pressing member interposing the booklet, for conveying the booklet by movement thereof;

(c) a controller for controlling the moving device; and (d) a cutting device for cutting an edge on a side opposite to the end of the booklet, which has been conveyed by the moving device to a cutting position, wherein the controller controls the moving device so that the moving device moves in a direction of cutting position from a reference position to a temporary stop position that the detector detects the end on a side of the folded portion of the booklet, after that, the moving device interposes the booklet by the pressing member and moves again in the same direction with the interposing booklet up to a predetermined position which is constant for each sheet size, and wherein a sum of movement distance from the reference position to the predetermined position is constant for each sheet size, a movement distance from the reference position to the temporary stop position varies according to the number of sheets constituting the booklet, and a movement distance from the temporary stop position to the predetermined position varies according to the temporary stop position.

2. The finisher of claim 1, further comprising a center-stapling device for stapling the bundle of center-folded sheets at a center position thereof.

3. The finisher of claim 1, wherein the controller controls the movement of the moving device in accordance with a thickness of the sheet.

4. The finisher of claim 1, wherein the detector comprises an actuator capable of rotating so as to come into contact with the end of the booklet, and a sensor for detecting a rotation movement the actuator.

5. The finisher of claim 1, further comprising a leading edge stopper provided upstream of the cutting device in a conveyance direction of the booklet, with which the edge of the booklet comes into contact, wherein the detector detects the end on the side of the folded portion of the booklet at which the edge of the booklet is kept in contact with the leading edge stopper and stopped.

6. The finisher of claim 1, further comprising:

a leading edge stopper provided upstream of the cutting device in a conveyance direction of the booklet, with which the edge of the booklet comes into contact; and an alignment member provided in contact with the end of the folded portion for bringing the edge of the booklet into contact with the leading edge stopper to align the edge.

7. The finisher of claim 6, wherein the pressing member interposes the booklet after bringing the alignment member into contact with the end of the folded portion of the booklet and making the alignment member to separate from the end.

8. An image forming apparatus that includes a finisher for finishing a booklet having a bundle of center-folded sheets, the image forming apparatus comprising:

(a) an image recording device for recording an image onto a sheet constituting the booklet;

(b) a finisher of claim 1.

9. A finisher for finishing a booklet having a bundle of center-folded sheets, comprising:

(a) a detector for detecting an end on a side of a folded portion of the booklet:

(b) a moving device, which has a pressing member interposing the booklet, for conveying the interposed booklet by movement thereof;

(c) a controller for controlling the moving device; and (d) a cutting device for cutting an edge on a side opposite to the end of the booklet which has been conveyed by the moving device to a cutting position, wherein the controller controls the moving device so that the moving device moves in a direction of the cutting position from a reference position to a temporary stop position that the detector detects the end on a side of the folded portion of the booklet, after that, the moving device interposes the booklet by the pressing member and returns to the reference position with the interposing booklet, after that, the moving device moves with the interposing booklet from the reference position to a predetermined position which is constant for each sheet size.

10. The finisher of claim 9, further comprising a center-stapling device for stapling the bundle of center-folded sheets at a center position thereof.

11. The finisher of claim 9, further comprising:

a leading edge stopper with which the edge of the booklet comes into contact, and the detector detects the end of the folded portion of the booklet while the edge is kept in contact with the leading edge stopper and stopped.

12. The finisher of claim 9, wherein the moving device is driven by a stepping motor.

13. An image forming apparatus that includes a finisher for finishing a booklet having a bundle of center-folded sheets, the image forming apparatus comprising:

(a) an image recording device for recording an image onto a sheet constituting the booklet; and (b) the finisher of claim 9.

* * * * *